US011056840B2

(12) United States Patent
Bopp et al.

(10) Patent No.: US 11,056,840 B2
(45) Date of Patent: Jul. 6, 2021

(54) ELECTRICAL CONNECTOR SYSTEM WITH ALIEN CROSSTALK REDUCTION DEVICES

(71) Applicants: COMMSCOPE TECHNOLOGIES LLC, Hickory, NC (US); COMMSCOPE CONNECTIVITY UK LIMITED, Swindon (GB)

(72) Inventors: Steven Richard Bopp, Mount Pleasant, SC (US); Paul John Pepe, Clemmons, NC (US); Shawn Phillip Tobey, Trinity, NC (US); Bernard Harold Hammond, Jr., Cheltenham (GB)

(73) Assignees: CommScope Technologies LLC, Hickory, NC (US); CommScope Connectivity UK Limited, Swindon (GB)

( * ) Notice: Subject to any disclaimer, the term of this patent is extended or adjusted under 35 U.S.C. 154(b) by 0 days.

(21) Appl. No.: 16/802,023

(22) Filed: Feb. 26, 2020

(65) Prior Publication Data

US 2020/0303880 A1 Sep. 24, 2020

Related U.S. Application Data

(63) Continuation of application No. 16/074,798, filed as application No. PCT/US2017/015948 on Feb. 1, 2017, now Pat. No. 10,608,382.

(Continued)

(51) Int. Cl.
*H01R 13/6592* (2011.01)
*H01R 4/2445* (2018.01)

(Continued)

(52) U.S. Cl.
CPC ..... *H01R 13/6592* (2013.01); *H01R 4/2445* (2013.01); *H01R 13/506* (2013.01);

(Continued)

(58) Field of Classification Search
CPC ..... H01R 13/506; H01R 13/518; H01R 13/6592; H01R 13/743; H01R 4/2445; H01R 24/64

(Continued)

(56) References Cited

U.S. PATENT DOCUMENTS 6,056,586 A 5/2000 Lin
6,120,330 A 9/2000 Gwiazdowski (Continued)

OTHER PUBLICATIONS

International Search Report and Written Opinion of the International Searching Authority for International Patent Application No. PCT/US2017/015948 dated May 10, 2017, 13 pages.

*Primary Examiner* — Oscar C Jimenez
(74) *Attorney, Agent, or Firm* — Merchant & Gould P.C.

(57) ABSTRACT

An electrical connection system includes various devices and structures for improving alien crosstalk performance in a high density configuration. In certain examples, a plurality of insulation displacement contacts of a connector are arranged at angle and oriented to be symmetrical about an axial of the connector. The connector includes a connector housing and a shield cap configured to at least partially cover the connector housing. The shield cap includes a shield wall and an open side that is not closed by a shield wall. The shield wall exposes a portion of the connector when the shield cap is mounted to the connector housing. When a plurality of such connectors are arranged side by side in a high density configuration, the connectors are aligned such that the open side of the shield cap is arranged close to, or abutted to, the shield wall of the shield cap of an adjacent connector.

22 Claims, 18 Drawing Sheets

Related U.S. Application Data

(60) Provisional application No. 62/290,050, filed on Feb. 2, 2016.

(51) Int. Cl.
*H01R 13/506* (2006.01)
*H01R 13/518* (2006.01)
*H01R 13/74* (2006.01)
*H01R 24/64* (2011.01)

(52) U.S. Cl.
CPC ..... *H01R 13/518* (2013.01); *H01R 13/743* (2013.01); *H01R 24/64* (2013.01)

(58) Field of Classification Search
USPC ..... 439/620.11, 620.17, 607.26, 607.38, 439/607.41, 607.45
See application file for complete search history.

(56) References Cited

U.S. PATENT DOCUMENTS 6,280,234 B1 8/2001 Yamamoto et al.
6,319,069 B1 11/2001 Gwiazdowski
6,338,641 B2 1/2002 Nicholls
6,338,642 B2 1/2002 Nicholls
7,195,518 B2 3/2007 Bert et al.
7,232,340 B2 6/2007 Hammond, Jr. et al.
7,273,396 B2 9/2007 Itano et al.
7,294,024 B2 11/2007 Hammond, Jr. et al.
7,311,550 B2 12/2007 Hammond, Jr. et al.
7,381,098 B2 6/2008 Hammond, Jr. et al.
7,402,085 B2 7/2008 Hammond, Jr. et al.
7,413,464 B1 8/2008 Chen
7,510,438 B2 3/2009 Hammond, Jr. et al.
7,517,255 B2 4/2009 Hetzer et al.
7,563,125 B2 7/2009 Pepe et al.
7,604,503 B2 10/2009 Hammond, Jr. et al.
7,695,307 B2 4/2010 Moessner et al.
7,726,018 B2 6/2010 Caveney et al.
7,787,615 B2 8/2010 Hammond, Jr. et al.
7,946,894 B2 5/2011 AbuGhazaleh et al.
7,950,951 B2 5/2011 Moessner et al.
8,002,571 B2 8/2011 Hogue et al.
8,007,311 B2 8/2011 Hogue et al.
8,016,619 B2 9/2011 Hogue et al.
8,075,347 B2 12/2011 Hogue et al.
8,133,069 B2 3/2012 Hogue et al.
8,151,457 B2 4/2012 Hammond, Jr. et al.
8,272,888 B2 9/2012 Hogue et al.
8,313,338 B2 11/2012 Hogue et al.
8,403,709 B2 3/2013 Hammond, Jr. et al.
8,632,362 B2 1/2014 Straka et al.
8,781,284 B2 7/2014 Bragg
8,900,015 B2 12/2014 Yuan et al.
8,958,680 B2 2/2015 Bragg
8,979,578 B2 3/2015 Hogue et al.
9,065,223 B2 6/2015 Hammond, Jr. et al.
9,077,126 B2 7/2015 Bragg
9,236,691 B2 1/2016 Bragg
9,847,607 B2 12/2017 Bopp et al.
10,608,382 B2 * 3/2020 Bopp ..... H01R 13/6592
2002/0094715 A1 7/2002 Pepe et al.
2007/0026736 A1 2/2007 Itano et al.
2007/0207679 A1 9/2007 Kleinschmidt et al.
2008/0090456 A1 4/2008 Bernat et al.
2009/0021904 A1 1/2009 Yang
2009/0111300 A1 4/2009 Jaouen et al.
2009/0124136 A1 5/2009 Pepe et al.
2009/0258544 A1 10/2009 Allwood
2011/0053428 A1 3/2011 Pepe et al.
2011/0136371 A1 6/2011 Wang
2012/0202389 A1 8/2012 Erickson et al.
2012/0244736 A1 9/2012 Duran et al.
2013/0090005 A1 4/2013 Nesme et al.
2013/0164966 A1 6/2013 Pepe et al.
2014/0037259 A1 2/2014 Bragg
2014/0342616 A1 11/2014 Pepe et al.
2015/0301289 A1 10/2015 Nhep
2015/0311646 A1 10/2015 Bopp et al.
2016/0336699 A1 11/2016 Trio et al.
2017/0012374 A1 1/2017 Riccardi
2017/0229825 A1 8/2017 Baines et al.
2018/0254586 A1 9/2018 Valenti et al.

* cited by examiner

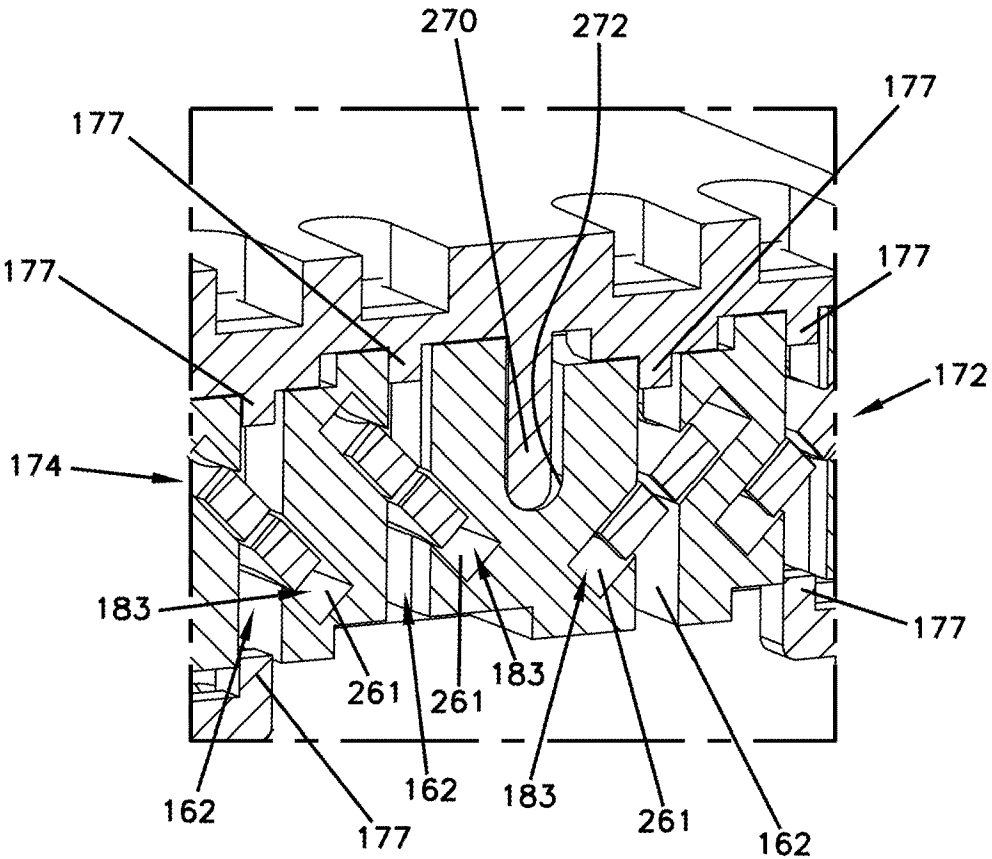
FIG. 10B
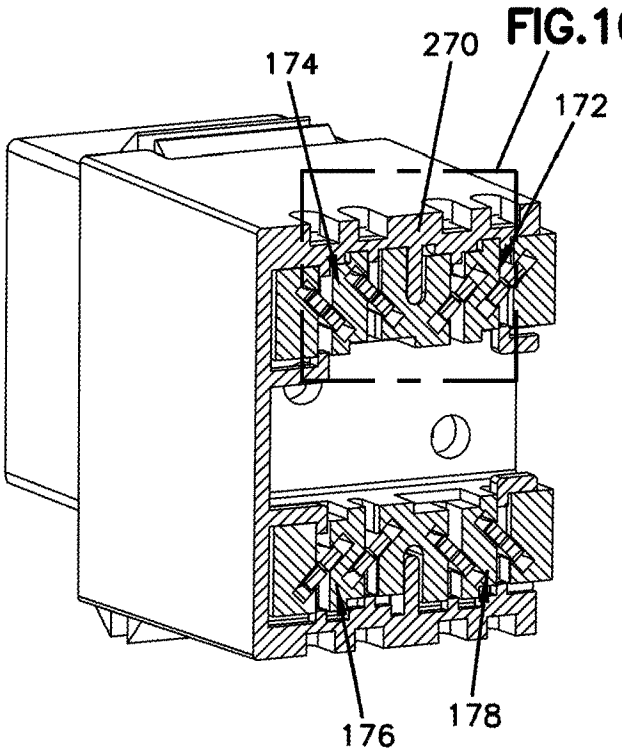
FIG.10B
FIG. 10A

ELECTRICAL CONNECTOR SYSTEM WITH ALIEN CROSSTALK REDUCTION DEVICES

CROSS-REFERENCE TO RELATED APPLICATION

This application is a Continuation of U.S. patent application Ser. No. 16/074,798, filed on Aug. 2, 2018, now U.S. Pat. No. 10,608,382, which is a National Stage Application of PCT/US2017/015948, filed on Feb. 1, 2017, which claims the benefit of U.S. Patent Application Ser. No. 62/290,050, filed on Feb. 2, 2016, the disclosures of which are incorporated herein by reference in their entireties. To the extent appropriate, a claim of priority is made to each of the above disclosed applications.

BACKGROUND

Electrical connectors, such as modular jacks and modular plugs, are commonly used in telecommunications systems. Such connectors may be used to provide interfaces between successive runs of cable in telecommunications systems and between cables and electronic devices. In the field of data communications, communications networks typically utilize techniques designed to maintain or improve the integrity of signals being transmitted via the network ("transmission signals"). To protect signal integrity, the communications networks should, at a minimum, satisfy compliance standards that are established by standards committees, such as the Institute of Electrical and Electronics Engineers (IEEE). The compliance standards help network designers provide communications networks that achieve at least minimum levels of signal integrity as well as some standard of compatibility.

To promote high circuit density, communications networks typically include a plurality of electrical connectors that bring transmission signals in close proximity to one another. For example, the contacts of multiple sets of jacks and plugs are positioned fairly closely to one another. However, such a high density configuration is particularly susceptible to alien crosstalk inference.

Alien crosstalk is electromagnetic noise that can occur in a cable that runs alongside one or more other signal-carrying cables or in a connector that is positioned proximate to another connector. The term "alien" arises from the fact that this form of crosstalk occurs between different cables in a bundle or different connectors in a group, rather than between individual wires or circuits within a single cable or connector. Alien crosstalk affects the performance of a communications system by reducing the signal-to-noise ratio.

Various arrangements are introduced to reduce alien crosstalk between adjacent connectors. One possible solution is to separate the cables and/or connectors from each other by a predetermined distance so that the likelihood of alien crosstalk is minimized. This solution, however, reduces the density of cables and/or connectors that may be used per unit of area.

The telecommunications industry is constantly striving toward larger signal frequency ranges. As transmission frequency ranges widen, crosstalk becomes more problematic. Thus, there is a need for further development of electrical connectors with high efficiency in reducing the crosstalk between adjacent connectors.

SUMMARY

In general terms, this disclosure is directed to an electrical connection system. In one possible configuration and by non-limiting example, the connector system includes various devices for improving alien crosstalk performance in a high density configuration. Various aspects are described in this disclosure, which include, but are not limited to, the following aspects.

One aspect is an electrical connector including a connector housing and a shield cap. The connector has a front end and a rear end and includes a cavity opened at the front end for receiving a plug, and a plurality of insulation displacement contacts supported by the connector housing. The insulation displacement contacts extend from the connector housing at the rear end and include a first pair, a second pair, a third pair, and a four pair. The first, second, third, and fourth pairs are symmetrically arranged about an axis of the connector housing, and the plurality of insulation displacement contacts are oriented at an angle relative to a reference line and symmetrical about the axis of the connector housing. The shield cap is configured to be mounted to the connector housing at the rear end and includes an end portion, a shield wall, an open side, and a cable sleeve. The end portion has an inner surface and an outer surface. The shield wall extends from the end portion and includes a first wall, a second wall opposite to the first wall, and a third wall extending between the first wall and the second wall. The first, second, and third walls are configured to partially cover the connector housing when the shield cap is mounted to the connector housing. The open side is arranged opposite to the third wall and configured to expose the connector housing therethrough when the shield cap is mounted to the connector housing. The cable sleeve extends from the outer surface of the end portion of the shield cap and includes an axial opening defined along an axial length of the cable sleeve.

In certain examples, a cable can be snap-fit into the cable sleeve through the axial opening. The axial opening may be arranged in the same direction as the open side of the shield cap.

In certain examples, the shield cap includes a shield rib extending from the inner surface of the end portion and configured to be disposed between adjacent pairs of the first, second, third, and fourth pairs when the shield cap is mounted to the connector housing. The connector housing may include a receiving slot at the rear end. The receiving slot may be configured to receive the shield rib of the shield cap when the shield cap is mounted to the connector housing.

In certain examples, the electrical connector is secured to a panel interface housing including a plurality of holes. Each hole can be configured to at least partially receive the electrical connector. The panel interface housing may include at least one shield wall arranged between the holes. The shield wall is configured to be disposed between adjacent connector housings when a plurality of the electrical connectors is received within the holes.

In certain examples, the shield wall is made from a non-conductive material having conductive particles dispersed therein. The shield cap may be integrally made from a non-conductive material having conductive particles dispersed therein.

Another aspect is an electrical connection system including a plurality of connectors and a panel interface. Each of the plurality of connectors includes a connector housing and a shield cap. The connector housing has a front end and a rear end and includes a cavity a cavity opened at the front end for receiving a plug, and a plurality of insulation displacement contacts supported by the connector housing. The insulation displacement contacts extend from the connector housing at the rear end and include a first pair, a second pair, a third pair, and a four pair. The first, second, third, and fourth pairs are symmetrically arranged about an axis of the connector housing, and the plurality of insulation displacement contacts is oriented at an angle relative to a reference line and symmetrical about the axis of the connector housing. The shield cap is configured to be mounted to the connector housing at the rear end and includes an end portion, a shield wall, an open side, and a cable sleeve. The end portion has an inner surface and an outer surface. The shield wall extends from the end portion and includes a first wall, a second wall opposite to the first wall, and a third wall extending between the first wall and the second wall. The first, second, and third walls are configured to partially cover the connector housing when the shield cap is mounted to the connector housing. The open side is arranged opposite to the third wall and configured to expose the connector housing that is uncovered by the shield wall when the shield cap is mounted to the connector housing. The cable sleeve extends from the outer surface of the end portion of the shield cap and includes an axial opening defined along an axial length of the cable sleeve. The panel interface housing includes a plurality of connector holes configured to at least partially receive the plurality of connectors. The plurality of connectors are inserted into the plurality of connector holes respectively such that the third wall of the shield cap of a connector of the plurality of connectors faces the open side of the shield cap of an adjacent connector of the plurality of connectors.

In certain examples, the shield cap includes a shield rib extending from the inner surface of the end portion and configured to be disposed between adjacent pairs of the first, second, third, and fourth pairs when the shield cap is mounted to the connector housing.

In certain examples, the connector housing includes a receiving slot at the rear end. The receiving slot is configured to receive the shield rib of the shield cap when the shield cap is mounted to the connector housing.

In certain examples, the panel interface housing includes at least one shield wall arranged between the holes. The shield wall is configured to be disposed between adjacent connector housings when a plurality of the electrical connectors is received within the holes.

In certain examples, the shield wall is made from a non-conductive material having conductive particles dispersed therein. The shield cap may be integrally made from a non-conductive material having conductive particles dispersed therein.

The above features and advantages and other features and advantages of the present teachings are readily apparent from the following detailed description for carrying out the present teachings when taken in connection with the accompanying drawings.

BRIEF DESCRIPTION OF THE DRAWINGS

FIG. 10A is a schematic cross-sectional view of the contact subassembly and the shield cap.

FIG. 10B is an enlarged view of the cross-sectional view of FIG. 10A.

DETAILED DESCRIPTION

Figure 1:
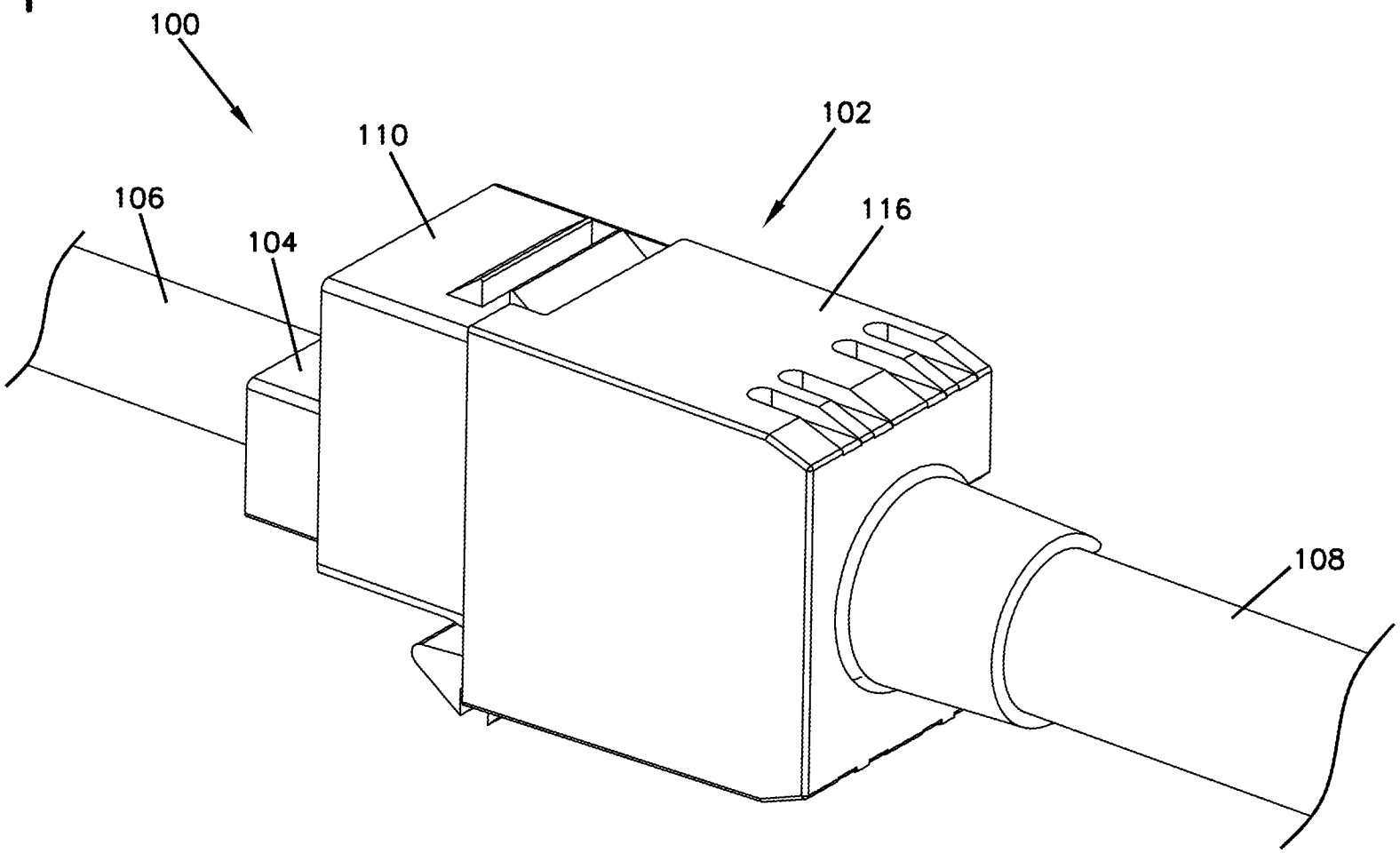
FIG. 1 is a rear perspective view of an electrical connector assembly in accordance with an exemplary embodiment of the present disclosure.

Various embodiments will be described in detail with reference to the drawings, wherein like reference numerals represent like parts and assemblies throughout the several views.

FIG. 1 is a perspective view of an electrical connector assembly 100 in accordance with an exemplary embodiment of the present disclosure. The connector assembly 100 includes a jack assembly 102, which can be also referred to herein as an electrical connector. The jack assembly 102 is configured to receive a plug 104 for transmitting high speed electronic signals between a first multi-conductor cable 106 and a second multi-conductor cable 108. In some examples, the plug 104 is an RJ-45 type. However, the plug 104 can be of any type of variation. The multi-conductor cables 106 and 108 can be twisted-pair cables having a plurality of insulated wire conductors running throughout the corresponding cable. In this disclosure, the term "conductive," or other similar phrase, is used to refer to electrical conductivity, and thus can be interchangeably used with "electrically conductive."

In some examples, the electrical connector assembly 100 is configured for category 6A cables. Although category 6A cables have improved alien crosstalk characteristics, connectors for category 6A cables still need enhanced alien crosstalk transmission performance when arranged in high density configurations. As described herein, the connector assembly 100 includes various devices and structures for reducing alien crosstalk between adjacent connectors in high density configurations. In other examples, the electrical connector assembly 100 is configured for other types of cables.

Figure 2:
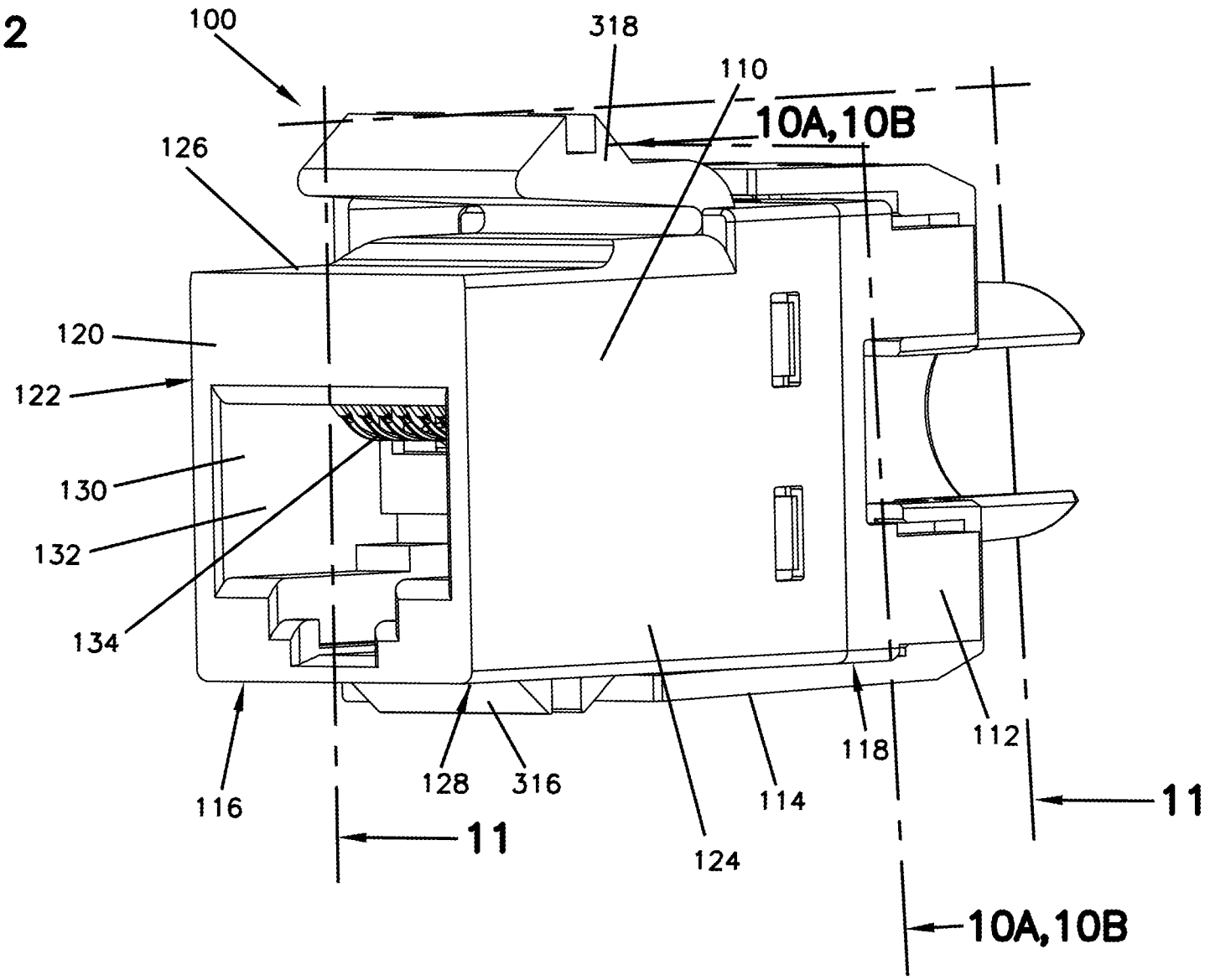
FIG. 2 is a front perspective view of the electrical connector assembly of FIG. 1.
Figure 3:
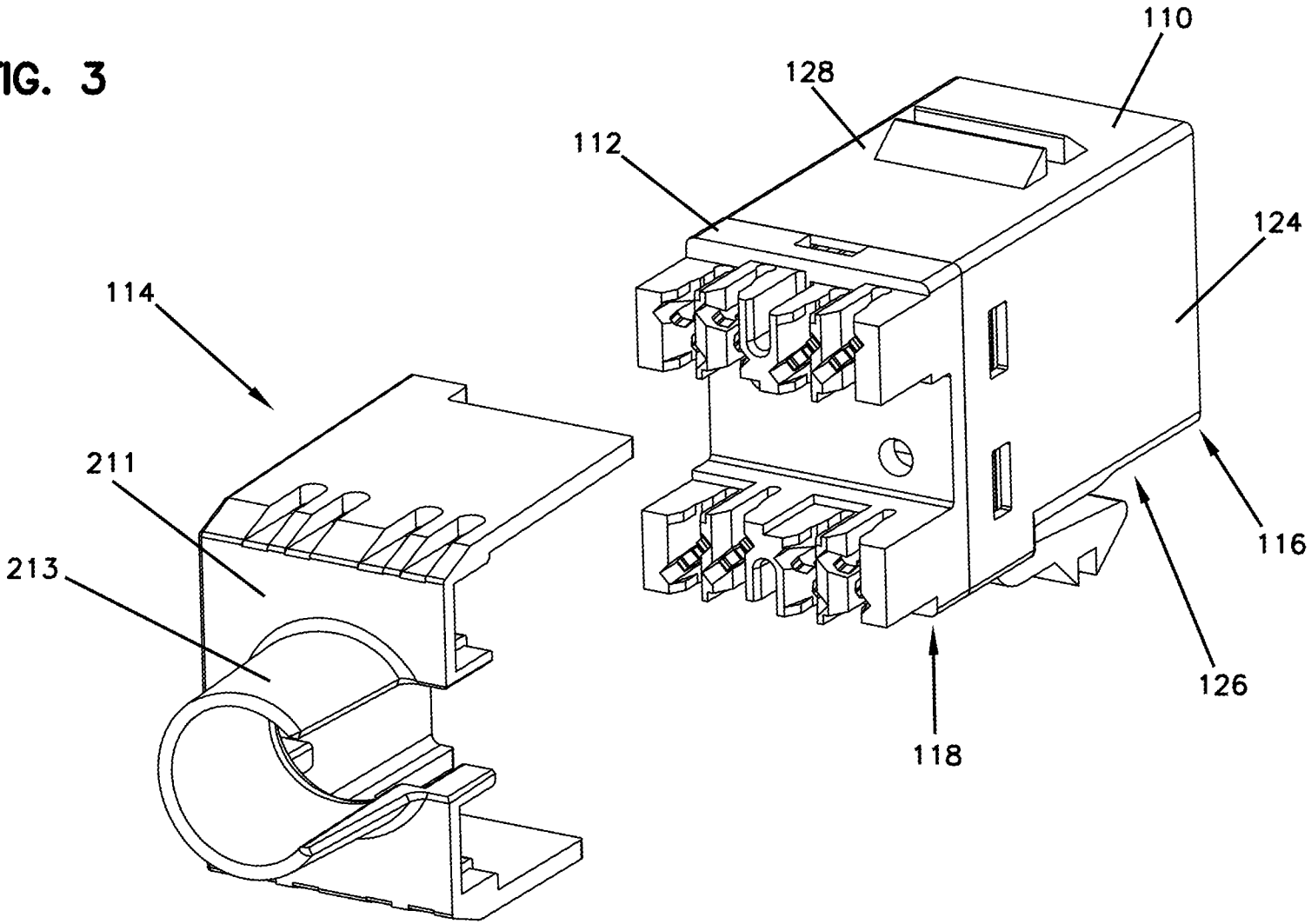
FIG. 3 is a rear perspective view of the electrical connector assembly of FIG. 1 before a shield cap engages a contact subassembly.

Referring to FIGS. 1-3, the jack assembly 102 includes a jack housing 110, a contact subassembly 112, and a shield cap 114. The jack housing 110 and the contact subassembly 112 can be collectively referred to herein as a connector housing. The jack housing 110 has a front end 116 and a rear end 118. The plug 104 is received to the front end 116, and the contact subassembly 112 is coupled to the rear end 118. The shield cap 114 is connected to the jack housing 110 and/or the contact subassembly 112 and configured to at least partially cover the contact subassembly 112 and electrical components exposed from the contact subassembly 112. In other examples, the jack housing 110 and the contact subassembly 112 are integrally formed. It is noted that the electrical connector assembly 100 as illustrated in the present disclosure is only a non-limiting example and many other variations and types of connectors or connector assemblies can be used in accordance with the principles of the present disclosure.

The jack housing 110 has a substantially rectangular shape and includes a front face 120, opposite sides 122 and 124, a top side 126, and a bottom side 128. The front face 120 is arranged at the front end 116 of the jack housing 110. The opposite sides 122 and 124, the top side 126, and the bottom side 128 extend between the front end 116 and the rear end 118 of the jack housing 110. The front face 120 forms an opening 130 that leads to a cavity 132 configured to receive the plug 104. The cavity 132 includes an array of electrical contacts 134 that extend through the jack housing 110 from the front end 116 to the rear end 118 and terminate at a corresponding wire termination conductor 180 on the contact subassembly 112. In this disclosure, the wire termination conductors 180 are depicted as insulation displacement contacts (IDC's) but could be other types of wire termination conductors such as wire wraps or pins. In certain examples, the arrangement of the electrical contacts 134 may be at least partially determined by industry standards, such as, but not limited to, International Electrotechnical Commission (IEC) 60603-7 or Electronics Industries Alliance/Telecommunications Industry Association (EIA/TIA)-568.

In some examples, the jack housing 110 is fabricated from a non-conductive material or dielectric material. In other examples, the jack housing 110 is made from a non-conductive material having conductive particles dispersed therein. The conductive particles form a conductive network that facilitates providing EMI/RFI shielding for the electrical connector assembly 100. As such, the jack housing 110 is adapted to avoid formation of a conductive path. More specifically, the jack housing 110 may be configured to avoid forming a conductive path with an electrical contact 134 (FIG. 2).

The contact subassembly 112 is configured to provide a plurality of insulation displacement contacts 180 that is electrically connected to a plurality of conductors stripped at the end of the cable 108. The contact subassembly 112 is described in further detail with reference to FIGS. 4-7.

Similarly to the jack housing 110, the contact subassembly 112 can be fabricated from a non-conductive material or dielectric material. In other examples, the contact subassembly 112 is made from a non-conductive material having conductive particles dispersed therein. The conductive particles form a conductive network that facilitates providing EMI/RFI shielding for the electrical connector assembly 100.

The shield cap 114 operates to at least partially cover the contact subassembly 112 (and/or electrical components exposed therefrom) for crosstalk shielding and pass the cable 106 therethrough. As described herein, the shield cap 114 is configured to reduce crosstalk between adjacent electrical connectors in a high density configuration, in which a plurality of electrical connectors are arranged close to one another. Further, the shield cap 114 is configured to be disposed in such a high density configuration without requiring additional space. Examples of the shield cap 114 are described in more detail with reference to FIGS. 8A, 8B, and 9.

Figure 11:
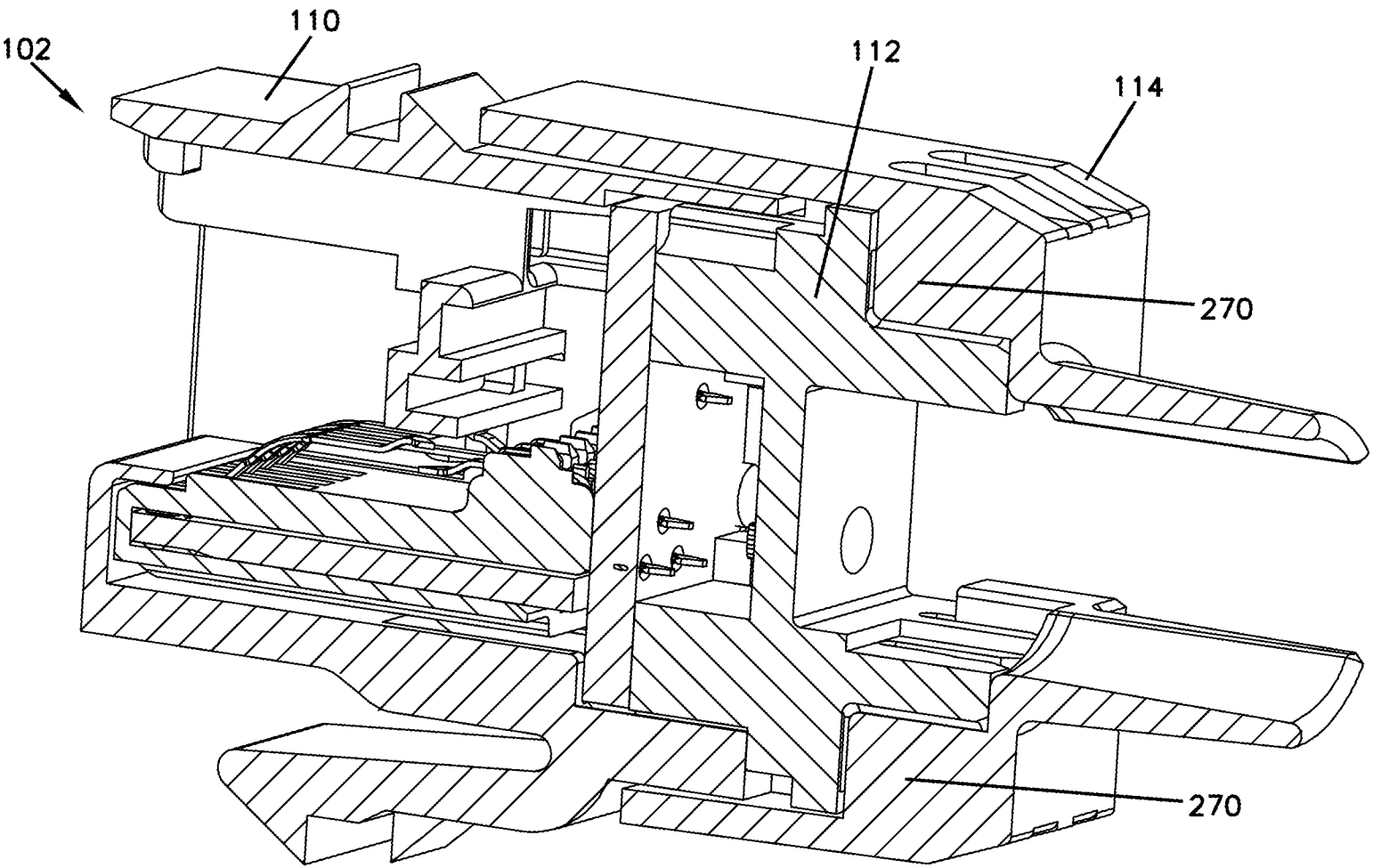
FIG. 11 is a cross-sectional view of the jack assembly of FIGS. 1-3.

Referring to FIGS. 4-7, an example of the contact subassembly 112 is described in more detail. The contact subassembly 112 includes a back cover 202 having an outer surface 204 and a covering edge 206 that defines a perimeter of the back cover 202. The back cover 202 encloses and holds a circuit board 262 (FIG. 11) within the jack housing 110. The circuit board 262 is configured to define circuit paths that extend from the plurality of electrical contacts 134 to the plurality of insulation displacement contacts 180, thereby electrically connecting the electrical contacts 134 and the insulation displacement contacts 180.

In some examples, the contact subassembly 112 includes a plurality of arms 152 that project axially outward away from the outer surface 204 of the contact subassembly 112, and thus from the rear end 118 of the jack housing 110. The plurality of arms 152 extend at an angle that is substantially perpendicular to the outer surface 204. The arms 152 can be integrally formed with the contact subassembly 112.

The plurality of arms 152 defines a plurality of conductor channels 162 configured to accommodate the insulation displacement contacts 180 therein. In particular, adjacent arms 152 define a conductor channel 162 therebetween. In the illustrated examples, eight conductor channels 162 are defined by the arms 152.

The contact subassembly 112 includes a plurality of insulation displacement contacts (IDCs) 180 accommodated within the conductor channels 162, respectively. In some examples, the contact subassembly 112 includes four pairs of insulation displacement contacts, which includes a first IDC pair 172, a second IDC pair 174, a third IDC pair 176, and a fourth IDC pair 178.

Figure 7:
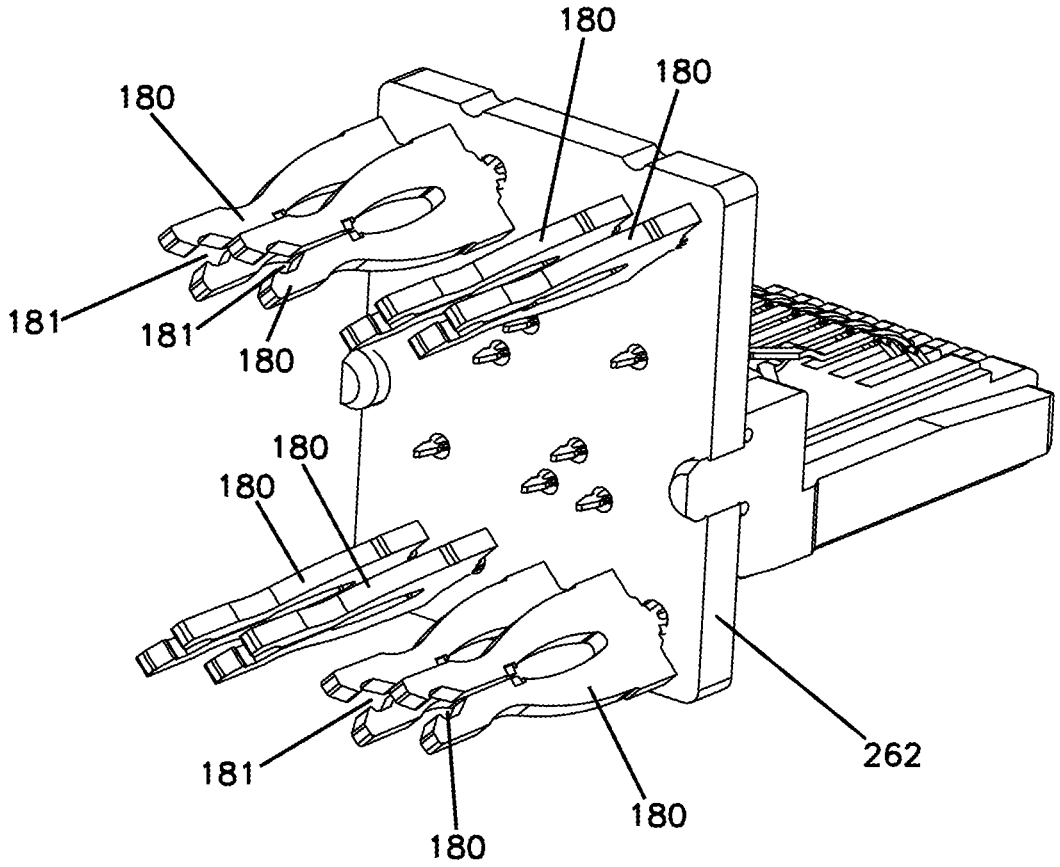
FIG. 7 schematically illustrates various components of the jack assembly of FIG. 4.

As illustrated in FIG. 7, each IDC 180 has a slot 181 configured to hold a conductor stripped at the end of the cable 108 when the electrical connector assembly 100 is in operation. The slot 181 of each IDC 180 is oriented and rests within the corresponding conductor channel 162 so that the slot 181 can receive a conductor of the cable 108.

Figure 4:
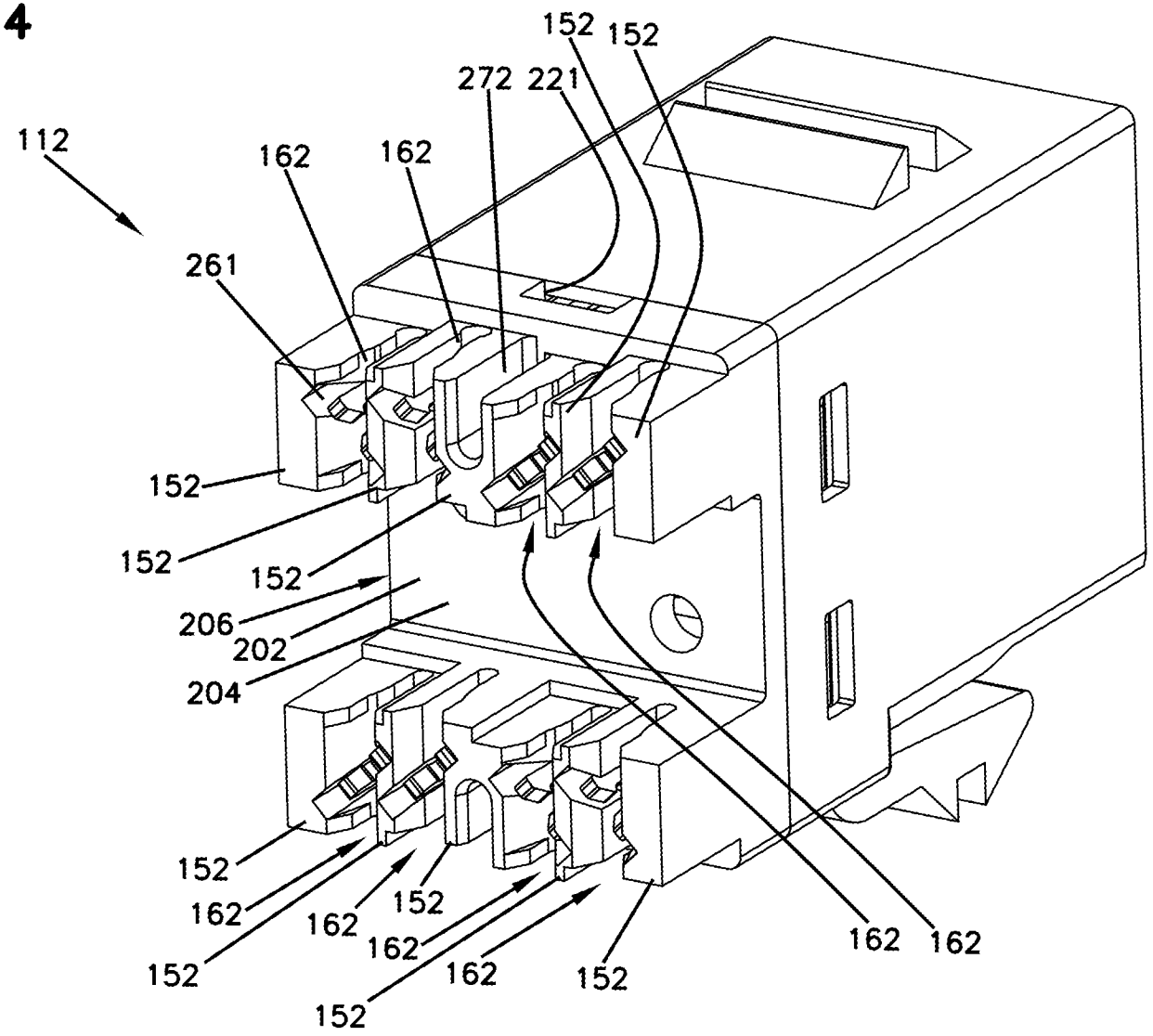
FIG. 4 is a schematic perspective view of an example jack assembly without the shield cap.

As illustrated in FIGS. 4 and 10B, adjacent arms 152 are configured to surround an IDC 180. Each arm includes a cut-out section 183 for receiving a portion of the IDC 180. The adjacent cut-outs 183 form an IDC channel 261 that intersects a corresponding conductor channel 162. In some examples, the IDC channel 261 and the corresponding conductor channel 162 are arranged to be non-perpendicular and thus form an angle less than or greater than 90 degree. This configuration allows the IDC's 180 to be positioned closer to each other to increase density of IDC's 180 used by the jack assembly 102.

As illustrated, the four IDC pairs 172, 174, 176, and 178 are symmetrically arranged about an axis C of the contact subassembly 112. In particular, the four IDC pairs 172, 174, 176, and 178 are symmetrically arranged about the axis C on the back cover 202 of the contact subassembly 112. For example, the first and second IDC pairs 172 and 174 are symmetric about a vertical axis Lv extending through the axis C, and the third and fourth pairs 176 and 178 are symmetric about the vertical axis Lv. The first and third IDC pairs 172 and 176 are symmetric about a horizontal axis LH extending through the center axis C and intersecting with the vertical axis Lv at the center axis C, and the second and fourth IDC pairs 172 and 176 are symmetric about the horizontal axis LH. In some examples, the axis C extends through the center of the back cover 202 of the contact subassembly 112.

In some examples, the IDC's 180 are oriented to be symmetrical about the axis C of the contact subassembly 112. As the IDC's 180 are received within the IDC channels 261, the IDC channels 261 are also symmetrically arranged about the axis C of the contact subassembly 112. In particular, the IDC channels 261 (and thus the IDC's 180) are oriented at a same angle A relative to the vertical axis Lv (thus at a same angle B relative to the horizontal axis LH). For example, the IDC channels 261 are arranged at an angle of 45 degrees relative to the vertical axis Lv (thus relative to the horizontal axis LH). Other angles are also possible in other embodiments.

In some examples, a vertical distance between the IDC pairs is different from a horizontal distance between the IDC pairs. For example, the distances between the first and second IDC pairs 172 and 174 and between the third and fourth IDC pairs 176 and 178 are configured to be different from the distances between the first and fourth IDC pairs 172 and 178 and between the second and third IDC pairs 174 and 176. In other examples, the vertical distance between the IDC pairs are configured to be the same as the horizontal distance between the IDC pairs. For example, the distances between the first and second IDC pairs 172 and 174 and between the third and fourth IDC pairs 176 and 178 are configured to be the same as the distances between the first and fourth IDC pairs 172 and 178 and between the second and third IDC pairs 174 and 176.

The configuration of the IDC pairs as described above can provide electrical cancellation and increase distances between adjacent connectors arranged in a high density configuration, such as with patch panels and faceplates. Further, the structure of the IDC pairs can reduce alien crosstalk between adjacent IDC pairs within the same connector.

Figure 5:
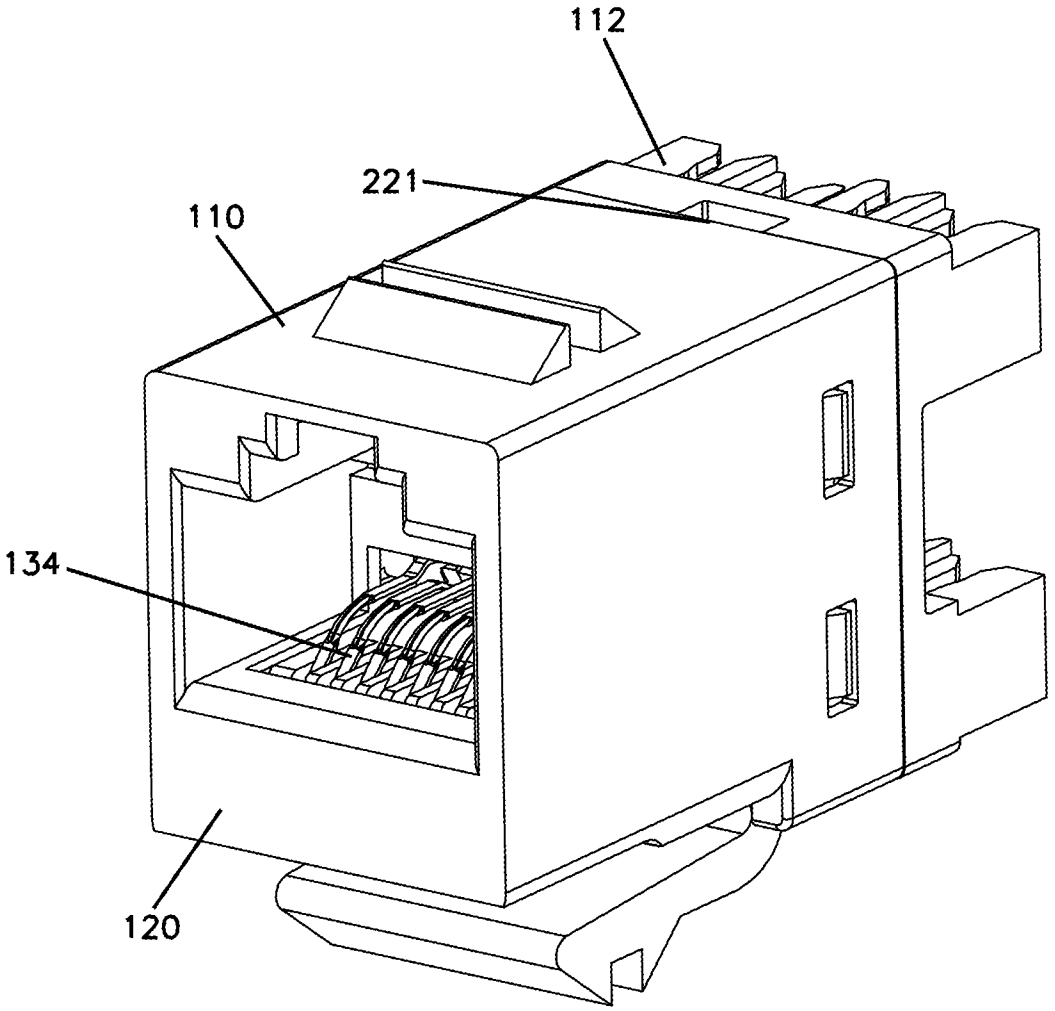
FIG. 5 is another schematic perspective view of the jack assembly of FIG. 4 without the shield cap.
Figure 6:
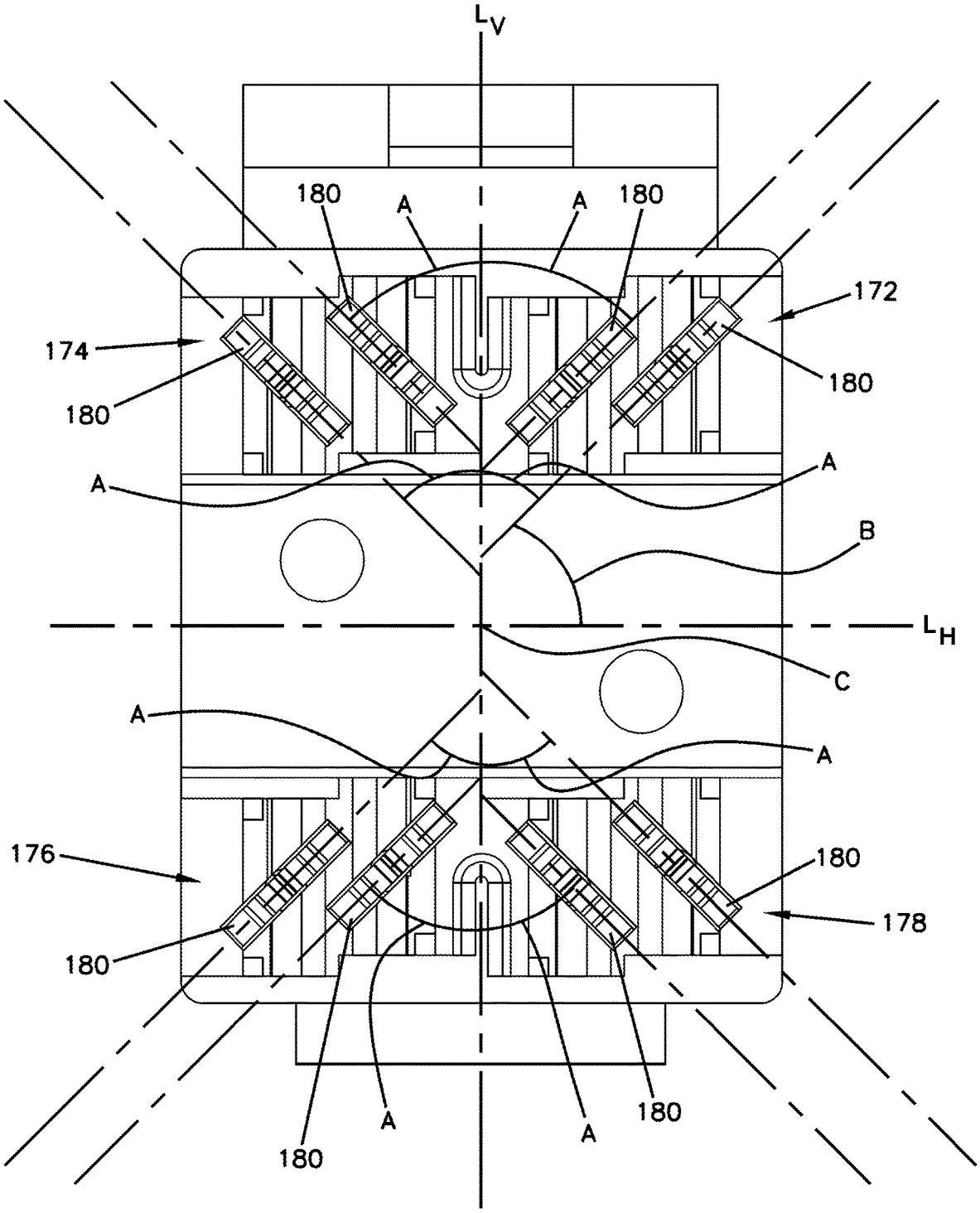
FIG. 6 is a schematic front view of the jack assembly of FIG. 4 without the shield cap, illustrating the contact subassembly.

Referring FIGS. 4 and 5, some examples of the contact subassembly 112 include engaging grooves 221 for engaging corresponding latch projections 218 (FIG. 8B) of the shield cap 114. As described below, the shield cap 114 is configured to cover at least partially the contact subassembly 112 and assist each wire conductor of the cable 108 to engage the slot 181 of each IDC 180 when assembling the shield cap 114 to the contact subassembly 112. The structure of the contact subassembly 112 is disclosed in further detail by U.S. Pat. No. 7,563,125, entitled "Jack Assembly for Reducing Crosstalk," to Paul John Pepe, et al. The entirety of the patent is herein incorporated by reference.

Figure 8B:
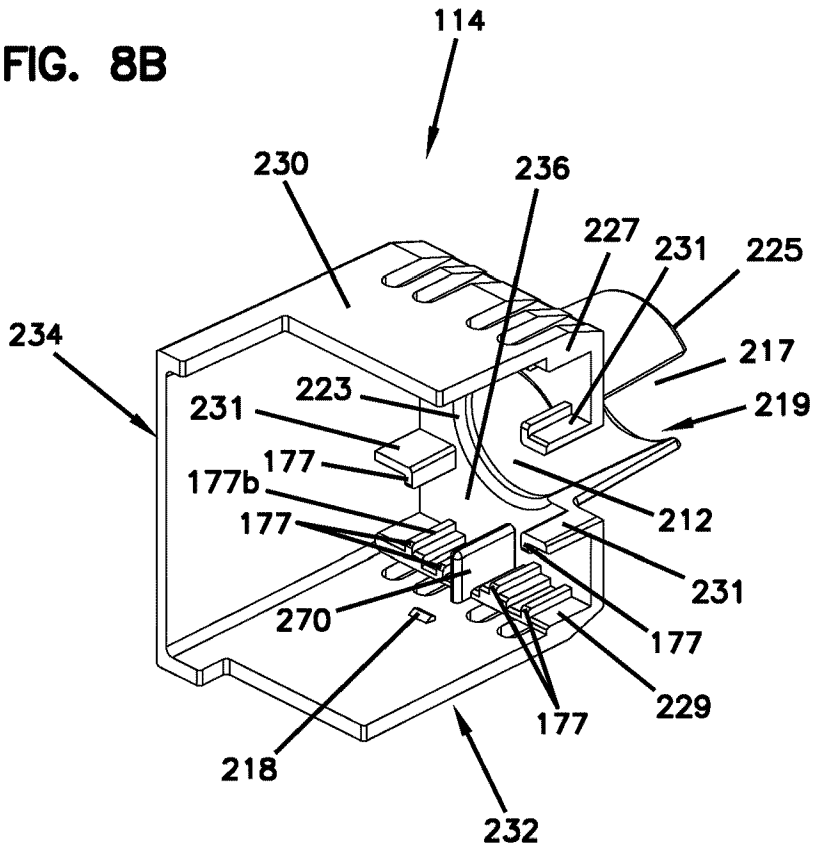
FIG. 8B is another schematic perspective view of the shield cap of FIG. 8A.
Figure 8A:
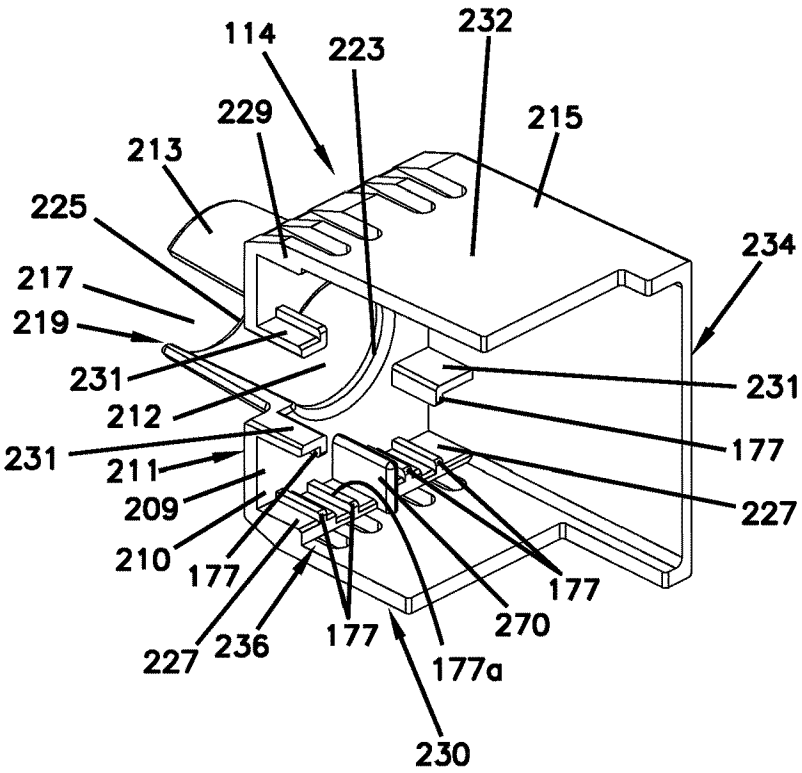
FIG. 8A is a schematic perspective view of an example of the shield cap of FIGS. 1-3.
Figure 9:
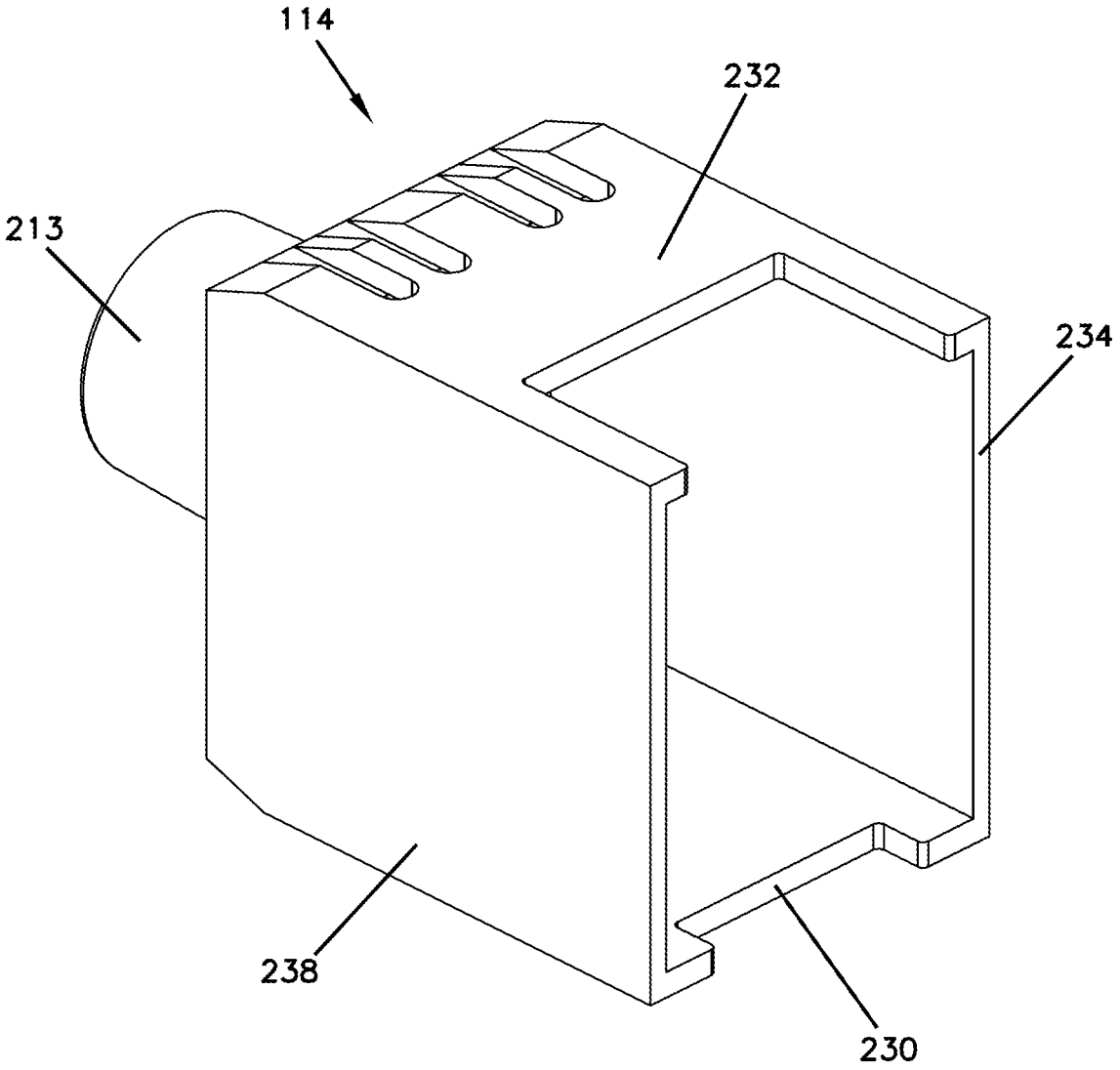
FIG. 9 is a schematic perspective view of another example shield cap for the jack assembly of FIGS. 4-6.

Referring to FIGS. 8A, 8B, and 9, examples of the shield cap 114 are described in more detail. In particular, FIG. 8A is a top perspective view of the shield cap 114 in accordance with an exemplary embodiment of the present disclosure. FIG. 8B is a bottom perspective view of the shield cap 114 of FIG. 8A. FIG. 9 is a perspective view of another example of the shield cap 114.

As illustrated FIGS. 1 and 2, the shield cap 114 is configured to at least partially cover the jack housing 110 and/or the contact subassembly 112. The shield cap 114 includes an end portion 209 having an inner surface 210 and an outer surface 211. The shield cap 114 includes a cable sleeve 213 extending from the outer surface 211 thereof The end portion 209 of the shield cap 114 includes a cable sleeve opening 212 formed on the inner surface 210 and leading into and through the cable sleeve 213. The shield cap 114 includes one or more shield walls 215 extending from the end portion 209 in a direction opposite to the cable sleeve 213 and defining an interior of the shield cap 114. The cable sleeve 213 is configured to receive the cable 108 and provide strain relief for the cable 108 when the cable 108 is engaged with the contact subassembly 112. The cable sleeve 213 also operates as a bend limiter for the cable 108.

As illustrated in FIGS. 8A and 8B, the cable sleeve 213 can include an axial opening 217 defined along the length of the cable sleeve 213. The axial opening 217 is configured such that the cable 108 is snapped into the cable sleeve 213 through the axial opening 217. For example, the cable 108 can be engaged with the cable sleeve 213 by inserting through the axial opening 217. As described below, the axial opening 217 of the cable sleeve 213 is arranged in the same orientation as an open side 236 of the shield cap 114. Thus, when the cable 108 is snapped into the cable sleeve 213 through the axial opening 217, a stripped end of the cable 108 can be simultaneously inserted into the interior of the shield cap 114 through the open side 236 of the shield cap 114, and can then be engaged with the IDCs 180. The cable 108 can be also snapped off from the cable sleeve 213 through the axial opening 217. In other examples, in order to connect the cable 108 to the jack assembly 102, a stripped end of the cable 108 can be first inserted through the cable sleeve 213 and advanced toward the contact subassembly 112.

In some examples, the shield cap 114 includes an open side. As illustrated in FIGS. 8A and 8B, the shield cap 114 can have three shield walls 215, including a top wall 230, a bottom wall 232, and a side wall 234. The top, bottom, and side walls 230, 232, and 234 extend outward at a substantially perpendicular angle with respect to the inner surface 210. In some examples, when the shield cap 114 is engaged with the jack housing 110, the top wall 230, the bottom wall 232, and the side wall 234 of the shield cap 114 can at least partially slide on, and are engaged with, the top side 126, the bottom side 128, and the side 122 of the jack housing 110, respectively. The shield cap 114 does not have a portion or wall that covers the other side 124 of the jack housing 110. In particular, a side 236 of the shield cap 114 opposite to the side wall 234 has no wall, and thus, the shield cap 114 is open at the side 236. In some examples, the open side 236 is arranged along with the axial opening 217 of the cable sleeve 213. For example, the axial opening 217 of the cable sleeve 213 is arranged to face the same direction as the open side 236 of the shield cap 114. Therefore, an end of the cable 108 can be inserted into the shield cap 114 through the open side 236 of the shield cap 114, and a portion of the cable 108 can be snapped into the cable sleeve 213 through the axial opening 217 as the cable 108 is placed into the shield cap 114 through the open side 236. As described in more detail with reference to FIGS. 12 and 13, the open side 236 of the shield cap 114 and/or the axial opening 217 of the cable sleeve 213 allows a plurality of jack assemblies 102 to be arranged together (e.g., side by side) in a limited space, such as in a high density configuration, which providing improved alien crosstalk performance.

The shield walls 215, as well as the end portion 209 of the shield cap 114, are configured to cover the contact subassembly 114 and at least partially the jack housing 110 when the end portion 209 of the shield cap 114 engages the contact subassembly 114 or the jack housing 110. In the illustrated example of FIGS. 1-3, when the end portion 209 is coupled to the contact subassembly 114 by the latch projections 218, the top, bottom, and side walls 230, 232, and 234 cover the contact subassembly 114 adjacent the top side 126, the bottom side 128, and the side 122 of the jack housing 110 and also cover at least partially the jack housing 110.

Figure 12:
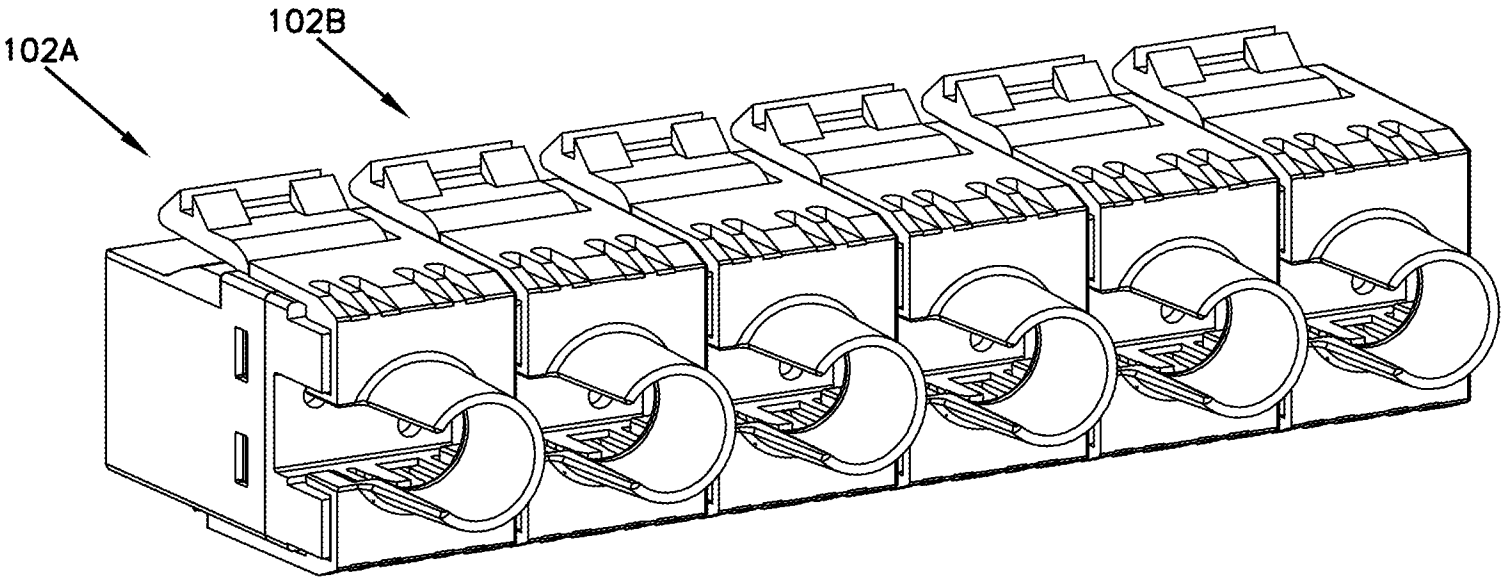
FIG. 12 is a schematic perspective view of a plurality of jack assemblies in a high density configuration.
Figure 13:
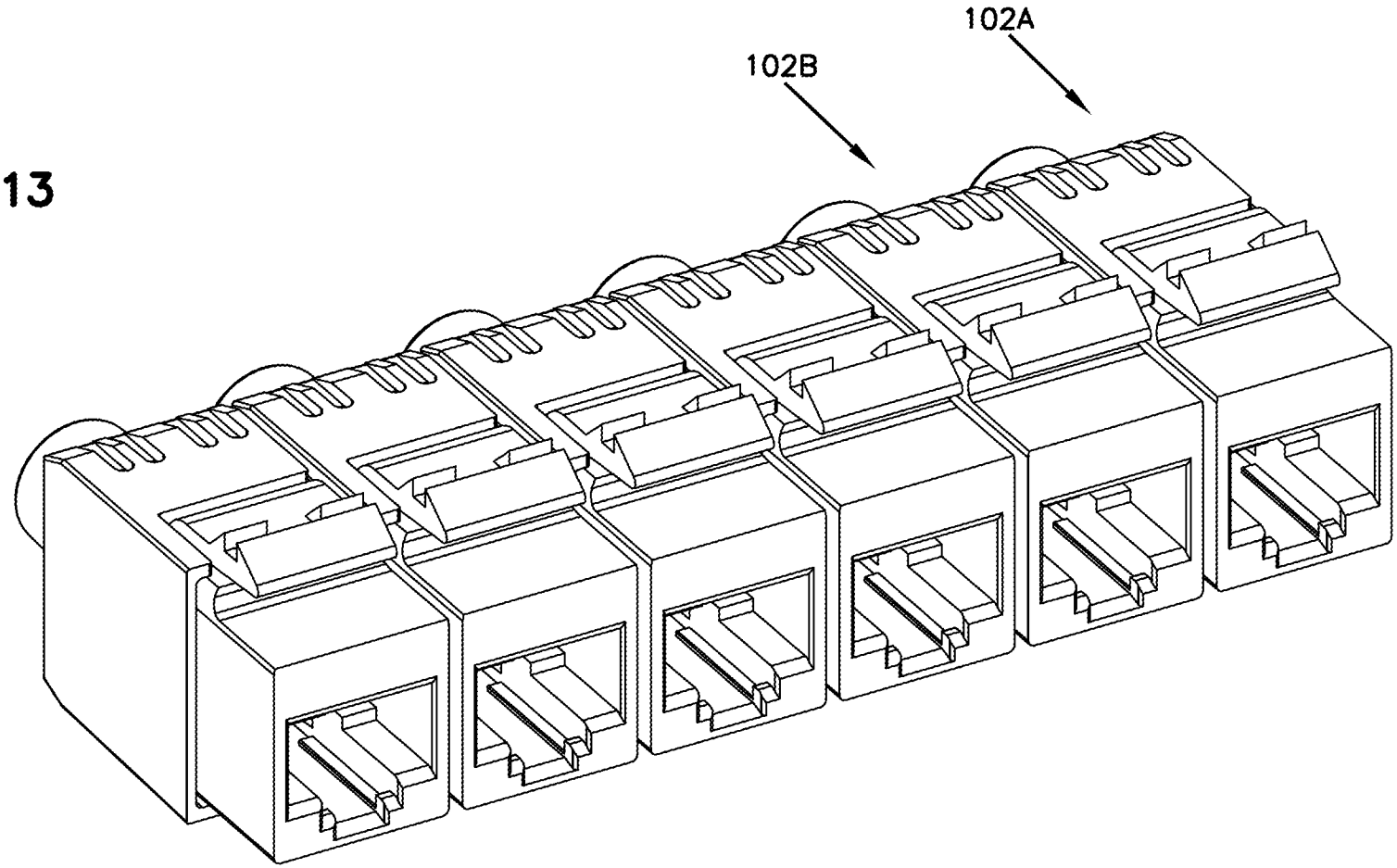
FIG. 13 is another schematic perspective view of the jack assemblies of FIG. 12.

As described in more detail with reference to FIGS. 12 and 13, the jack housing 110 and the contact subassembly 112 are exposed through the open side 236 of the shield cap 114 when the shield cap 114 is coupled to the contact subassembly 114 and/or the contact subassembly 114. However, when a plurality of jack assemblies 102 are arranged side by side in a high density configuration, one of the shield walls of a shield cap 114 of an adjacent jack assembly 102 is abutted to, or arranged close to, the jack housing 110 and the contact subassembly 112. As such, a shield wall of a shield cap 114 adjacent to the subject shield cap 114 can function as a shield wall for the exposed portion of the jack housing 110 and the contact subassembly 112 through the open side 236 of the shield cap 114. Accordingly, the shield cap 114, in cooperation with an adjacent shield cap 114, can enclose the IDCs 180 and the conductors of the cable 108 exposed at the contact subassembly 114 in the rear direction and shield them from other electrical components of adjacent electrical connector assemblies 100 (FIGS. 12 and 13). Further, the shield cap 114 can shield other electrical components, such as the electrical contacts 134 and the circuit board, contained in the jack housing 110.

The shield cap 114 can include one or more latch projections 218 formed on an inner surface of the shield walls 215. In some examples, two latch projections 218 is formed on inner surfaces of the top and bottom walls 230 and 232, respectively, for attaching the shield cap 114 to the jack housing 110 and/or the contact subassembly 112. In some examples, the shield walls 215 (or at least the top and bottom 230 and 232) are configured to flex outward so that the shield cap 114 slides onto the contact subassembly 114 and the latch projections 218 engage the corresponding engaging grooves 221 (FIG. 4). For example, as the shield cap 114 is inserted over the contact subassembly 114, each latch projection 218 slidably engages a corner or outer surface of the contact subassembly 114, which exerts an outward force on the top and bottom walls 230 and 232, respectively. The latch projections 218 continue to slide along the outer surface of the contact subassembly 114 until the latch projections 218 engage the engaging grooves 221 of the contact subassembly 114. In other examples, instead of the engaging grooves 221 of the contact subassembly 114, the jack housing 110 can have latch openings on the top side 126 and the bottom side 128 for engaging the latch projections 218.

The shield cap 114 can be fabricated from a non-conductive material. In some examples, the shield cap 114 is entirely made from a homogeneous non-conductive material without conductive materials or conductive particles. In some examples, the non-conductive material includes a polypropylene or other thermoplastic polymer. The non-conductive material may also include polymeric or plastic materials such as polycarbonate, ABS, and/or PC/ABS blend.

In other examples, the shield cap 114 may be made from a plastic blended with a material adapted for reducing crosstalk. For example, shield cap 114 can be made from a non-conductive material having conductive particles dispersed therein. The conductive particles may include, for example, a conductive powder or conductive fibers. For example, the conductive particles may be carbon powders, carbon fibers, silver coated glass beads or fibers, nickel coated carbon fibers, or stainless steel fibers. In some examples, the shield cap 114 can be made by die casting. In other examples, the shield cap 114 may be formed in an injection molding process that uses pellets containing the non-conductive material and the conductive particles. The pellets may be made by adding a conductive powder or conductive fibers to molten resin. After extruding and cooling the resin mixture, the material may be chopped or formed into pellets. Alternatively, the conductive powder or fiber may be added during an injection molding process. The conductive particles form a conductive network that facilitates providing crosstalk, EMI and/or RFI shielding. When the shield cap 114 is ultimately formed, the conductive particles may be evenly distributed or dispersed throughout. Alternatively, the conductive particles may be distributed in clusters. Further, during the molding process, the conductive particles may be forced to move (e.g., through magnetism or applied current) to certain areas so that the density of the conductive particles is greater in desired areas.

Figure 18:
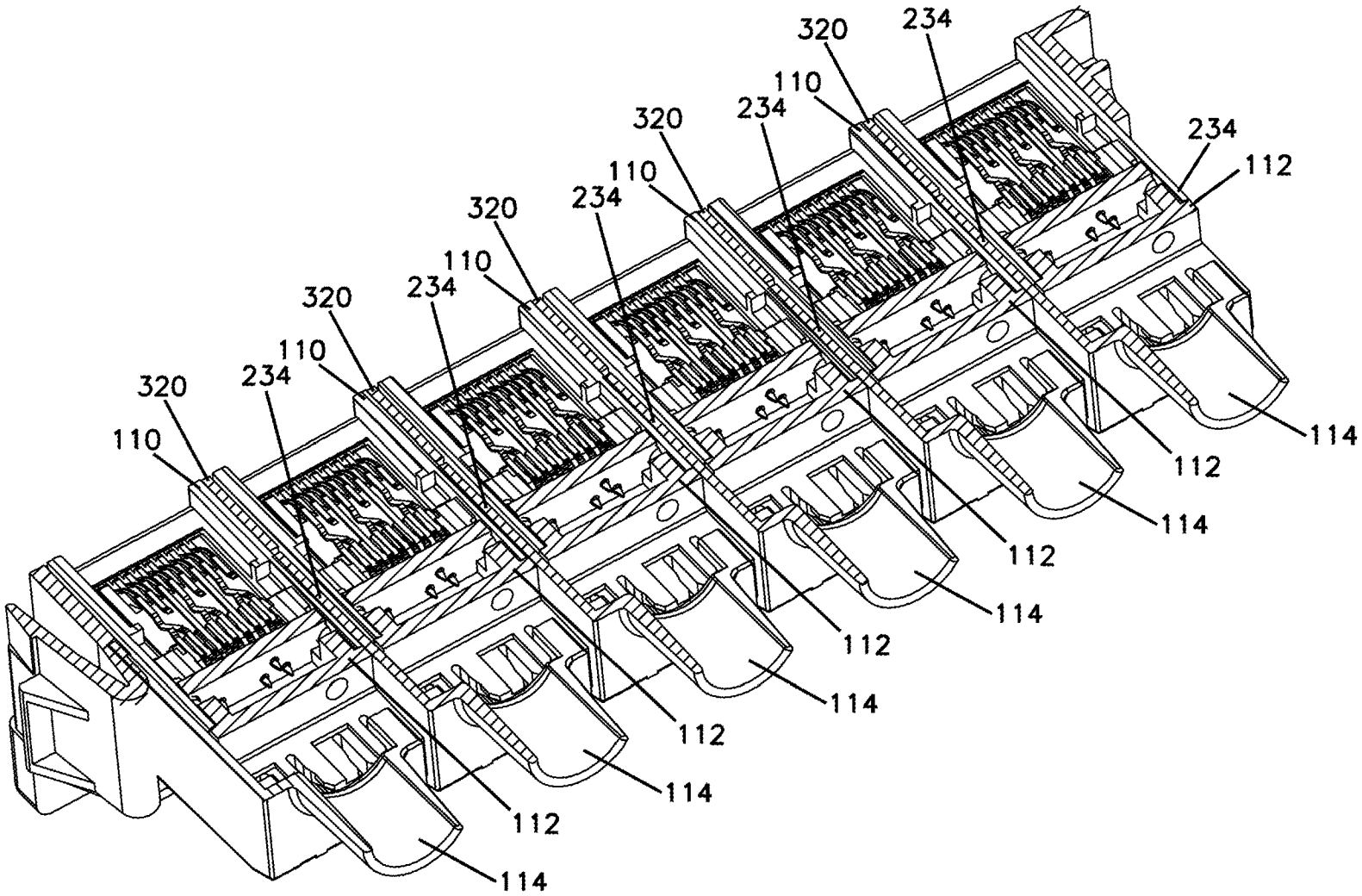
FIG. 18 is a schematic cross sectional view of the panel interface housing of FIG. 14 with the jack assemblies secured.

In yet other examples, the shield cap 114 can be made from metallic materials. The shield walls 215 made as a metallic plates can allow the shield cap 114 to be thin enough to save space when the electrical connector assemblies 100 are arranged as shown in FIG. 18. Further, the solid metallic plates enhance the strength of the shield cap 114 and show improved shielding performance. The shield cap 114 may be formed of any material suitable for minimizing crosstalk, EMI and/or RFI. The material may include, but not limited to, stainless steel, gold, nickel-plated copper, silver, silvered copper, nickel, nickel silver, copper or aluminum.

Referring to FIGS. 8A, 8B, 10A, and 10B, the end portion 209 of the shield cap 114 includes cross walls 177. As the shield cap 114 is slid over the contact subassembly 112, the cross walls 177 are inserted into the conductor channels 162 and engage and advance insulated wire conductors of the cable 108 into the conductor channels 162 and corresponding IDCs 180, respectively. In particular, when an axial force is applied to the shield cap 114, the cross walls 177 contact the wire conductors branching out from the cable 108 and advance the wire conductors through the slots 181, respectively. An example of such an engagement mechanism between the end portion 209 of the shield cap 114 and the contact subassembly 112 are further described in U.S. Pat. No. 7,563,125, entitled "Jack Assembly for Reducing Crosstalk," to Paul John Pepe, et al. The entirety of the patent is herein incorporated by reference.

Referring to FIG. 9, another example of the shield cap 114 is described. In this example, the shield cap 114 has a side wall 238 that is arranged to be opposite to the side wall 234 and block the open side 236 of the shield cap 114 of FIGS. 10A and 10B. Further, the shield cap 114 of this example includes the cable sleeve 213 without the axial opening 217. Other than the side wall 238 and the cable sleeve 213, the shield cap 114 in FIG. 9 is configured similarly to the shield cap 114 of FIGS. 8A and 8B. The axial opening 217 (i.e., cable opening) can include a predetermined form factor 219 sized and shaped to receive a cable therein. The predetermined form factor 219 can have a closed end and an open end. The predetermined form factor 219 includes a rounded portion 223 at the closed end and a neck portion 225 at the open end that extends from the rounded portion to form an open end at the open side. A first shoulder 227 can be formed on the bottom wall 232 (e.g., first side wall) that connects with an end portion at a first end thereof, and a second shoulder 229 can be formed on a top wall 230 (e.g., second side wall) that connects with the end portion at a second end thereof. The first and second shoulders 227, 229 can each have a length that extends from the side wall 234 (e.g., third side wall) to the open side 236. The first shoulder 227 can have a first plurality of cross-walls 177*a* that project therefrom and the second shoulder 229 can have a second plurality of cross-walls 177*b* that project therefrom. A plurality of barriers 231 can be positioned on an inner surface 210 of an end wall. The plurality of barriers can include a first barrier extending along a first edge of the neck portion, a second barrier opposite to the first barrier extending along an opposite, second edge of the neck portion, a third barrier extending from the third side wall in a direction towards the first barrier, and a fourth barrier extending from the third side wall in a direction towards the second barrier.

Referring to FIGS. 8A, 10A, 10B, and 11, the shield cap 114 includes a shield rib 270 that can be arranged between adjacent IDC pairs 172, 174, 176, and 178 when the shield cap 114 is assembled with the jack housing 110 and the contact subassembly 112. In the illustrated example, the shield rib 270 of the shield cap 114 is configured to be disposed between the first and second IDC pairs 172 and 174. In particular, the shield rib 270 extends from the inner surface 210 of the end portion 209 and is arranged between the cross walls 177 corresponding to the first and second IDC pairs 172 and 174. In some examples, the shield rib 270 is also connected to an inner surface of the top wall 230. Alternatively, or in addition, another shield rib 270 can be formed on the inner surface 210 of the end portion 209 to be disposed between the third and fourth IDC pairs 176 and 178 when the shield cap 114 is engaged with the contact subassembly 112. As also illustrated in FIG. 4, the contact subassembly 112 includes a receiving slot, pocket, or cavity 272 configured to receive the shield rib 270 when the shield cap 114 is engaged with the contact subassembly 112. The shield rib 270 can create separation of adjacent IDC pairs 172, 174, 176, and 178 and thereby reduce crosstalk between such adjacent IDC pairs 172, 174, 176, and 178. Further, the shield rib 270 can operate as a guide element for aligning the shield cap 114 to the contact subassembly 112 when the shield cap 114 is slid onto the contact subassembly 112.

FIGS. 12 and 13 illustrate that a plurality of jack assemblies 102 arranged together in a high density configuration. For example, a plurality of jack assemblies 102 are arranged side by side for high circuit density. As illustrated, adjacent jack assemblies 102 (e.g., a first jack assembly 102A and a second jack assembly 102B) are arranged such that the open side 236 of the shield cap 114 of the first jack assembly 102A faces the side wall 234 of the shield cap 114 of the second jack assembly 102B. In this configuration, the side wall 234 of the shield cap 114 of the second jack assembly 102B can function as a shield wall between the first jack assembly 102A (including the contact subassembly 112 and other components thereof) and the second jack assembly 102B (including the contact subassembly 112 and other components thereof). Accordingly, a series of shield caps 114, each having an open side 236, can provide shield walls that surround the IDCs 180 and the conductors of the cable 108 exposed at the contact subassembly 114 of each of the jack assemblies 102 arranged side by side.

Referring to FIGS. 14-18, an electrical connection system 298 is described in accordance with an exemplary embodiment of the present disclosure. The system 298 includes a panel interface housing 300 configured to receive a plurality of jack assemblies 102 in a high density configuration as illustrated in FIGS. 12 and 13. As described below, the panel interface housing 300 is also configured to provide additional shield walls between adjacent jack assemblies 102.

Figure 14:
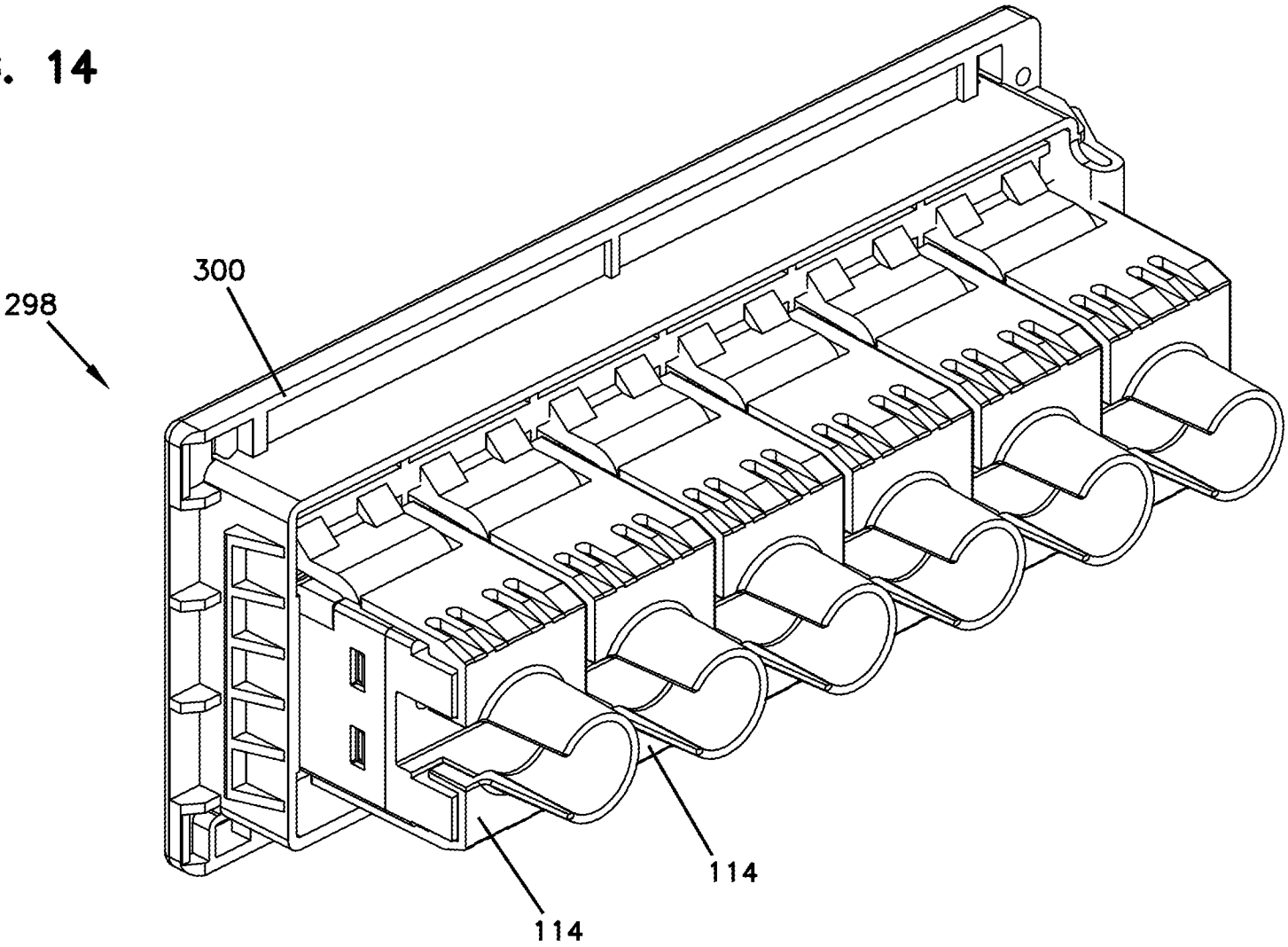
FIG. 14 is a schematic perspective view of a panel interface housing securing a plurality of jack assemblies in a high density configuration.
Figure 15:
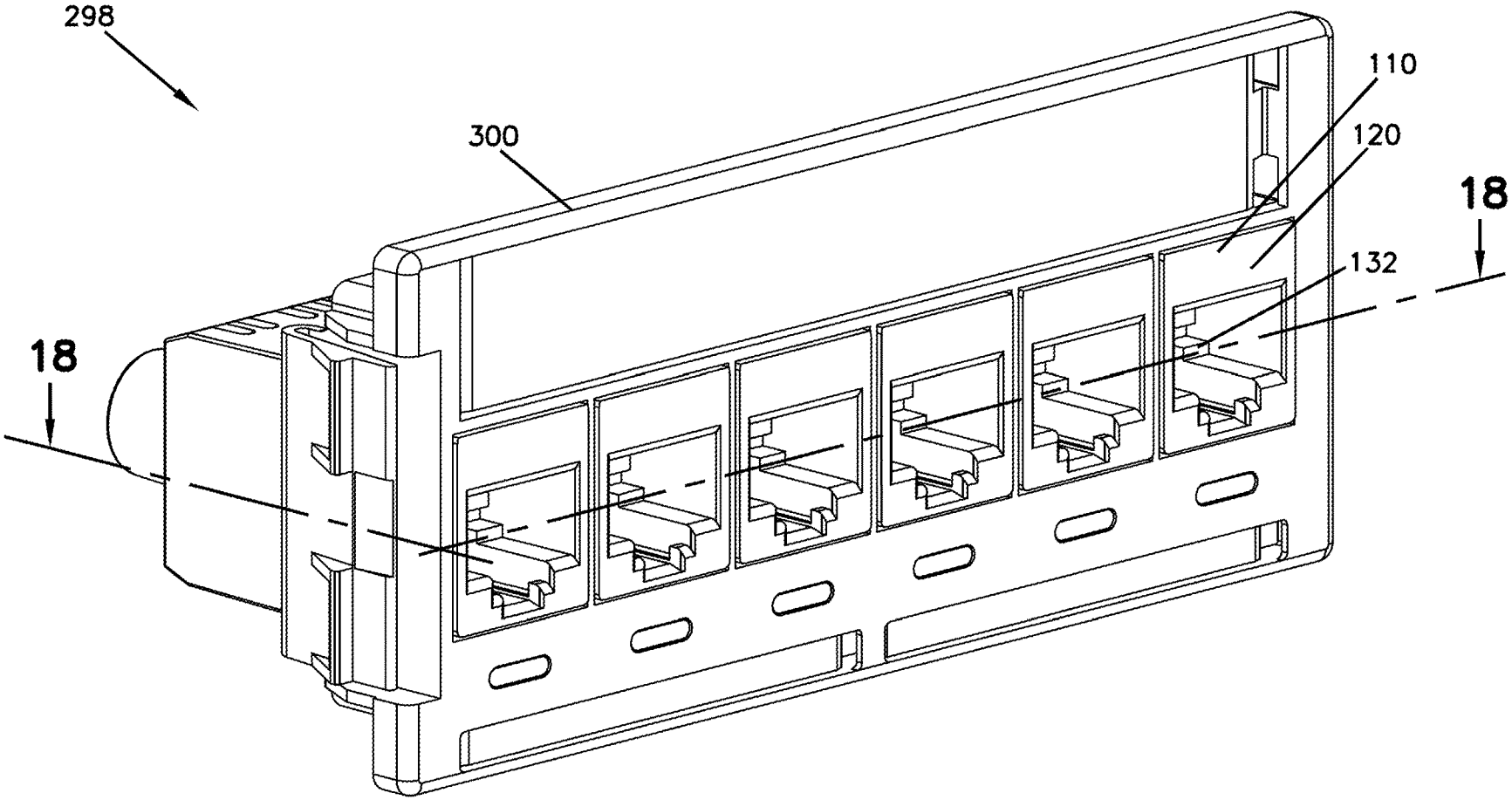
FIG. 15 is another schematic perspective view of the panel interface housing of FIG. 14 with the jack assemblies secured.
Figure 16:
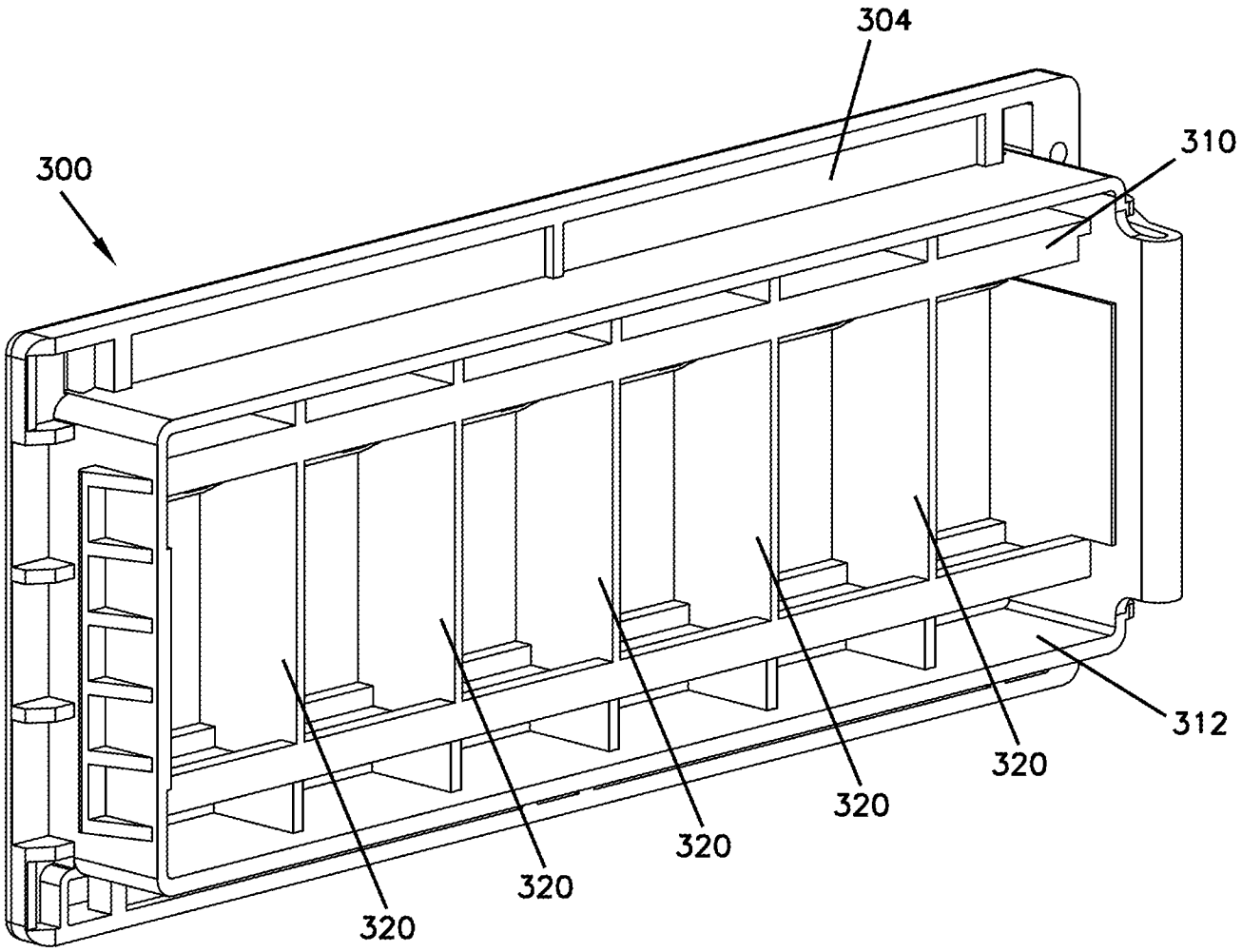
FIG. 16 is a schematic perspective view of the panel interface housing of FIG. 14.
Figure 17:
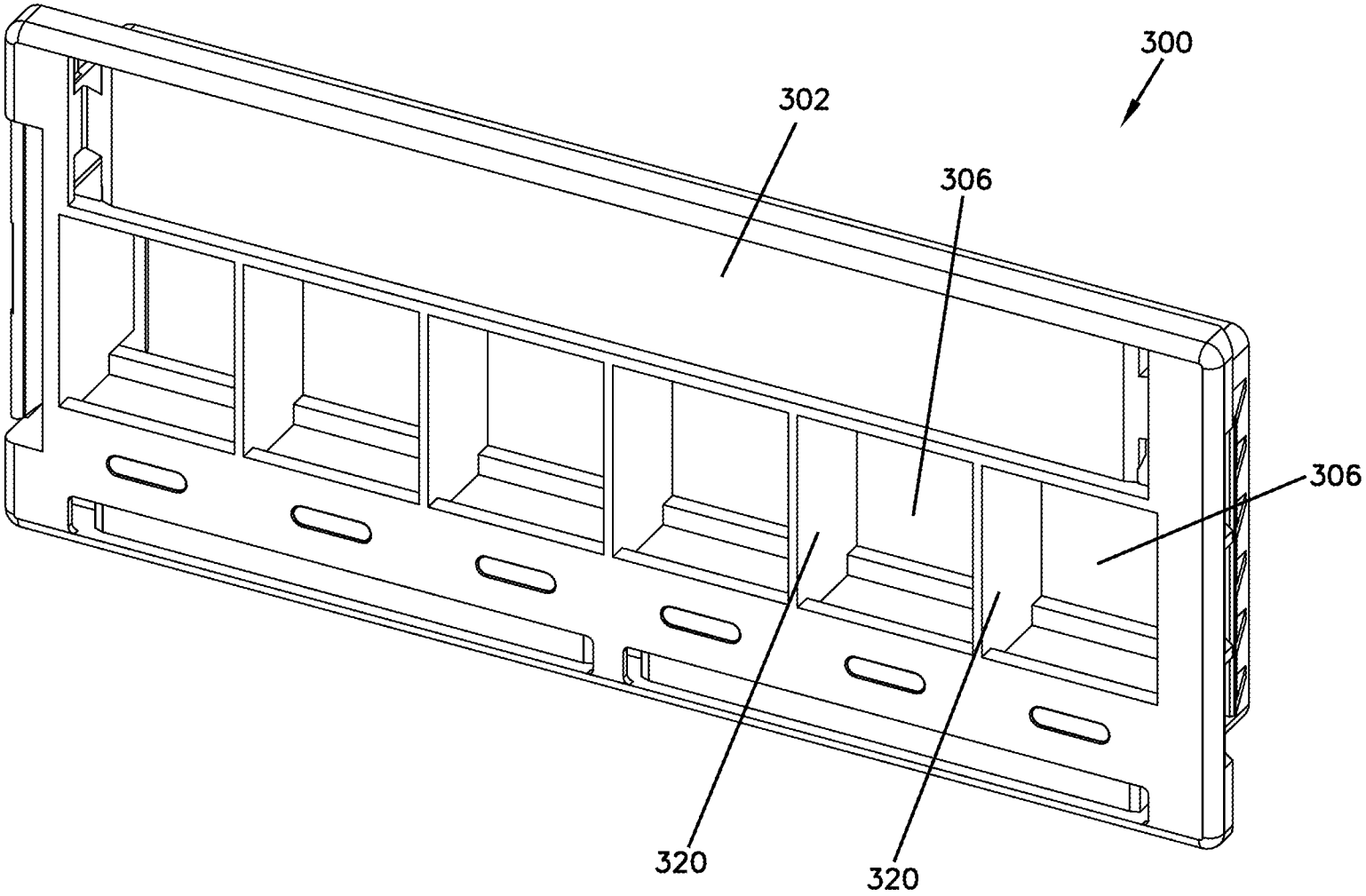
FIG. 17 is another schematic perspective view of the panel interface housing of FIG. 16.

As schematically illustrated in FIGS. 14 and 15, a plurality of jack assemblies 102 are secured to the panel interface housing 300 and arranged side by side as described in FIGS. 12 and 13. As illustrated in FIGS. 16 and 17, the panel interface housing 300 has an outer surface 302 and an inner surface 304, and a plurality of jack holes 306 extending between the outer surface 302 and the inner surface 304. Each of the jack holes 306 is configured to at least partially receive the jack housing 110 of the jack assembly 102 such that the front end 116 of the jack housing 110 is exposed on the outer surface 302 of the panel interface housing 300. In this arrangement, the shield caps 114 of the jack assemblies 102 are disposed to extend from the inner surface 304 of the jack housing 110.

The jack housing 110 includes a first support wall 310 and a second support wall 312 opposite to the first support wall 310. The first and second support walls 310 and 312 can cooperate to support the jack assemblies 102 therebetween. For example, the first support wall 310 is at least partially engaged with the bottom side 128 of the jack housing 110, and the second support wall 312 is at least partially engaged with the top side 126 of the jack housing 110. To secure the jack housing 110 with the first and second support walls 310 and 312, various locking members can be provided. In the illustrated example, such locking members include snap fit elements 316 and 318 (FIG. 2) provided on the top and bottom sides 126 and 128 of the jack housing 110. Other locking members can be provided in other embodiments.

With continued reference to FIGS. 16 and 17, the panel interface housing 300 includes a plurality of shield walls 320, each arranged between the jack holes 306. As illustrated in FIG. 18, the shield walls 320 are configured to be disposed between adjacent jack housings 110 when the jack assemblies 102 are inserted into the jack holes 306. The shield wall 320 is arranged in the same plane as the side wall 234 of the shield cap 114 so that the side wall 234 of the shield cap 114 and the shield wall 320 of the panel interface housing 300 are disposed between adjacent sets of the jack housing 110 and the contact subassembly 112. As such, the side walls 234 of the shield caps 114 are configured to provide shielding between the contact subassemblies 112 and rear portions of the jack housings 110 of adjacent jack assemblies 102, and the shield walls 320 of the panel interface housing 300 are configured to provide shielding between front portions (or the remaining portions) of the jack housings 110 of the adjacent jack assemblies 102. Accordingly, the shield caps 114 and the shield walls 320 of the panel interface housing 300 cooperate to provide improved shielding between adjacent jack assemblies 102.

The shield walls 320 can be made of various materials suitable for crosstalk shielding. In some examples, the shield walls 320 are made of the same materials as the shield caps 114. For example, the shield walls 320 can be fabricated from a non-conductive material. In some examples, the shield walls 320 are entirely made from a homogeneous non-conductive material without conductive materials or conductive particles. In some examples, the non-conductive material includes a polypropylene or other thermoplastic polymer. The non-conductive material may also include polymeric or plastic materials such as polycarbonate, ABS, and/or PC/ABS blend. In other examples, the shield walls 320 may be made from a plastic blended with a material adapted for reducing crosstalk. For example, the shield walls 320 can be made from a non-conductive material having conductive particles dispersed therein. The conductive particles may include, for example, a conductive powder or conductive fibers. For example, the conductive particles may be carbon powders, carbon fibers, silver coated glass beads or fibers, nickel coated carbon fibers, or stainless steel fibers. In other examples, the shield walls 320 are made of different materials from the shield caps 114.

In some examples, the shield walls 320 are made of materials different from other portions of the panel interface housing 300. In other examples, the shield walls 320 are integrally formed at least a portion of the panel interface housing 300 with the same materials.

Although the shield cap 114 in the present disclosure is primarily designed for category 6A cables, the shield cap 114 can be used or modified for other types of cables. The shield cap 114 as described herein is also configured to fit with a panel interface housing designed for category 6 cables.

The structures of the jack assembly 102 and the panel interface housing 300 in accordance with the present disclosure can prevent or reduce unwanted energy from entering or leaving crosstalk between adjacent connectors arranged in high density configurations such as with patch panels.

The various examples and teachings described above are provided by way of illustration only and should not be construed to limit the scope of the present disclosure. Those skilled in the art will readily recognize various modifications and changes that may be made without following the example examples and applications illustrated and described herein, and without departing from the true spirit and scope of the present disclosure.

What is claimed is:

1. An electrical connector comprising:

a connector housing having a front end and a rear end, the connector housing including:

a cavity opened at the front end for receiving a plug; and a plurality of insulation displacement contacts supported by the connector housing and extending from the connector housing at the rear end, wherein the plurality of insulation displacement contacts includes a first pair, a second pair, a third pair, and a fourth pair; and a cap configured to be mounted to the connector housing at the rear end, the cap being made from a material suitable for shielding cross-talk, the cap including:

a first side wall, a second side wall opposite to the first side wall, and a third side wall extending between the first side wall and the second side wall, the first, second, and third side walls configured to partially cover the connector housing when the cap is mounted to the connector housing, the cap including an open side arranged opposite to the third side wall, the open side configured to at least partially expose the connector housing therethrough when the cap is mounted to the connector housing;

an end wall having a first end and a second end opposite to the first end, the end wall being attached to the first, second, and third side walls to form an end portion of the cap, wherein the first end of the end wall is attached to the first side wall and the second end of the end wall is attached to the second side wall, the end portion having an inner surface and an outer surface, and the end portion defining a cable opening with a predetermined form factor sized and shaped to receive a cable therein, the predetermined form factor having a closed end and an open end;

wherein the predetermined form factor includes a rounded portion at the closed end and a neck portion at the open end that extends from the rounded portion to form an open end at the open side;

a first shoulder formed on the first side wall that connects with the end portion at the first end thereof, and a second shoulder formed on the second side wall that connects with the end portion at the second end thereof, the first and second shoulders having a length that extends from the third side wall to the open side, the first shoulder having a first plurality of cross-walls projecting therefrom and the second shoulder having a second plurality of cross-walls projecting therefrom;

a plurality of barriers positioned on the end wall, wherein the plurality of barriers includes a first barrier extending along a first edge of the neck portion, a second barrier opposite to the first barrier extending along an opposite, second edge of the neck portion, a third barrier extending from the third side wall in a direction towards the first barrier, and a fourth barrier extending from the third side wall in a direction towards the second barrier;

the first, second, third, and fourth barriers each having a cross-wall extending thereon, the cross-walls of the first and third barriers extending in a first direction that opposes the first plurality of cross-walls of the first shoulder, and the cross-walls of the second and fourth barriers extending in a second direction that opposes the second plurality of cross-walls of the second shoulder; and a latch positioned on an inner surface of the first and second side walls, the latch being configured to engage a corresponding latch receptacle of the connector housing to mount the cap to the connector housing.

2. The electrical connector according to claim 1, wherein the cap incudes a cable sleeve extending from the outer surface thereof, and wherein the cable sleeve includes an axial opening defined along an axial length of the cable sleeve.

3. The electrical connector according to claim 2, wherein the axial opening is arranged in the same direction as the open side of the cap.

4. The electrical connector according to claim 2, wherein the axial opening is configured such that the cable is snap-fit into the cable sleeve through the axial opening.

5. The electrical connector according to claim 2, wherein when the cap is mounted to the connector housing, the axial opening defined along the axial length of the cable sleeve remains open.

6. The electrical connector according to claim 1, further comprising a panel interface housing including a plurality of holes, each hole configured to at least partially receive the electrical connector.

7. The electrical connector according to claim 6, wherein the panel interface housing includes at least one panel shield wall arranged between the plurality of holes, the panel shield wall configured to be disposed between adjacent connector housings when a plurality of the electrical connectors are received within the plurality of holes.

8. The electrical connector according to claim 1, wherein the cap is integrally made from a non-conductive material having conductive particles dispersed therein.

9. The electrical connector according to claim 1, wherein the first barrier and the third barrier are aligned along a single plane.

10. The electrical connector according to claim 1, wherein the second barrier and the fourth barrier are aligned along a single plane.

11. An electrical connection system comprising:

a plurality of connectors, each connector according to claim 1; and a panel interface housing including a plurality of connector holes configured to at least partially receive the plurality of connectors, wherein the plurality of connectors are inserted into the plurality of connector holes respectively such that the third side wall of the cap of a connector of the plurality of connectors faces the open side of the cap of an adjacent connector of the plurality of connectors.

12. The electrical connector according to claim 1, wherein recessed surfaces are defined in the first and second side walls to provide clearance to exposed wire conductors of the cable after termination.

13. An electrical connector comprising:

a connector housing having a front end and a rear end, the connector housing including:

a cavity opened at the front end for receiving a plug; and a plurality of insulation displacement contacts supported by the connector housing and extending from the connector housing at the rear end; and a cap configured to be mounted to the connector housing at the rear end, the cap being made from a material suitable for shielding cross-talk, the cap including:

a first side wall, a second side wall opposite to the first side wall, and a third side wall extending between the first side wall and the second side wall, the first, second, and third side walls configured to partially cover the connector housing when the cap is mounted to the connector housing, the cap including an open side arranged opposite to the third side wall, the open side configured to at least partially expose the connector housing therethrough when the cap is mounted to the connector housing;

an end wall having a first end and a second end opposite to the first end, the end wall being attached to the first, second, and third side walls to form an end portion of the cap, wherein the first end of the end wall is attached to the first side wall and the second end of the end wall is attached to the second side wall, the end portion having an inner surface and an outer surface, and the end portion defining a cable opening with a predetermined form factor sized and shaped to receive a cable therein, the predetermined form factor having a closed end and an open end, wherein the predetermined form factor includes a rounded portion at the closed end and a neck portion at the open end that extends from the rounded portion to form an open end at the open side;

a first shoulder formed on the first side wall that connects with the end portion at the first end thereof, and a second shoulder formed on the second side wall that connects with the end portion at the second end thereof, the first shoulder having a first plurality of cross-walls projecting therefrom and the second shoulder having a second plurality of cross-walls projecting therefrom; and a first barrier extending along a first edge of the neck portion, a second barrier opposite to the first barrier extending along an opposite, second edge of the neck portion, a third barrier extending from the third side wall in a direction towards the rounded portion, the third barrier being aligned along a plane with the first barrier, and a fourth barrier extending from the third side wall in a direction towards the rounded portion, the fourth barrier being aligned along a plane with the second barrier;

wherein the first, second, third, and fourth barriers each have a cross-wall extending thereon, the cross-walls of the first and third barriers extending in a first direction that opposes the first plurality of cross-walls of the first shoulder, and the cross-walls of the second and fourth barriers extending in a second direction that opposes the second plurality of cross-walls of the second shoulder.

14. The electrical connector according to claim 13, wherein the cap incudes a cable sleeve extending from the outer surface thereof, and wherein the cable sleeve includes an axial opening defined along an axial length of the cable sleeve.

15. The electrical connector according to claim 14, wherein the axial opening is arranged in the same direction as the open side of the cap.

16. The electrical connector according to claim 14, wherein the axial opening is configured such that the cable is snap-fit into the cable sleeve through the axial opening.

17. The electrical connector according to claim 14, wherein when the cap is mounted to the connector housing, the axial opening defined along the axial length of the cable sleeve remains open.

18. The electrical connector according to claim 13, further comprising a panel interface housing including a plurality of holes, each hole configured to at least partially receive the electrical connector.

19. The electrical connector according to claim 18, wherein the panel interface housing includes at least one panel shield wall arranged between the plurality of holes, the panel shield wall configured to be disposed between adjacent connector housings when a plurality of the electrical connectors are received within the plurality of holes.

20. The electrical connector according to claim 13, wherein the cap is integrally made from a non-conductive material having conductive particles dispersed therein.

21. An electrical connection system comprising:

a plurality of connectors, each connector according to claim 13; and a panel interface housing including a plurality of connector holes configured to at least partially receive the plurality of connectors, wherein the plurality of connectors are inserted into the plurality of connector holes respectively such that the third side wall of the cap of a connector of the plurality of connectors faces the open side of the cap of an adjacent connector of the plurality of connectors.

22. The electrical connector according to claim 13, wherein recessed surfaces are defined in the first and second side walls to provide clearance to exposed wire conductors of the cable after termination.

* * * * *